US008265511B2

(12) United States Patent
Kosaka et al.

(10) Patent No.: US 8,265,511 B2
(45) Date of Patent: Sep. 11, 2012

(54) POWER SOURCE DEVICE AND IMAGE FORMING APPARATUS

(75) Inventors: Toru Kosaka, Tokyo (JP); Masao Yaji, Tokyo (JP); Akira Hagiwara, Tokyo (JP)

(73) Assignee: Oki Data Corporation, Tokyo (JP)

( * ) Notice: Subject to any disclaimer, the term of this patent is extended or adjusted under 35 U.S.C. 154(b) by 406 days.

(21) Appl. No.: 12/604,473

(22) Filed: Oct. 23, 2009

(65) Prior Publication Data

US 2010/0104313 A1 Apr. 29, 2010

(30) Foreign Application Priority Data

Oct. 29, 2008 (JP) ..... 2008-277697
Dec. 22, 2008 (JP) ..... 2008-325636

(51) Int. Cl.
*G03G 15/00* (2006.01)

(52) U.S. Cl. ..... 399/88

(58) Field of Classification Search ..... 399/37, 399/38, 66, 88, 299, 310; 363/157
See application file for complete search history.

(56) References Cited

U.S. PATENT DOCUMENTS 7,020,407 B2 * 3/2006 Nakata et al. ..... 399/66
2007/0201894 A1 * 8/2007 Kishi et al. ..... 399/88
2008/0152373 A1 * 6/2008 Ahn et al. ..... 399/66

FOREIGN PATENT DOCUMENTS

JP 11-206113 A 7/1999
JP 2006-091757 A 4/2006

* cited by examiner

*Primary Examiner* — Sandra Brase
(74) *Attorney, Agent, or Firm* — Panitch Schwarze Belisario & Nadel LLP

(57) ABSTRACT

A power source device includes an oscillator generating a clock, a frequency division unit dividing the clock to output a pulse, a sequence generation unit generating sequences "N" with respect to each switching of the pulse, a frequency division ratio setting unit setting frequency division ratio, a switching element driven by the pulse, and a piezoelectric transformer outputting alternating high voltage from a secondary-side when a primary-side is applied with voltage. The generated sequence and the set frequency division ratio are compared to output the pulses of fractional-M, -M+1 frequencies. An average frequency division ratio of the pulses of fractional-M, -M+1 frequencies determined by $(M\times\alpha)+(M+1)\times\beta/(\alpha+\beta)$, where $\alpha$ and $\beta$ respectively represent the number of pulses of "M" and "M+1" per unit time. The average frequency division ratio and frequency division ratio become equal at a sequence generation cycle and approximated in a period shorter than the sequence generation cycle.

14 Claims, 26 Drawing Sheets

POWER SOURCE DEVICE AND IMAGE FORMING APPARATUS

BACKGROUND OF THE INVENTION

1. Field of the Invention

The present invention relates to a power source device including a piezoelectric transformer and to an image forming apparatus such as an electrophotographic image forming apparatus using the power source device.

2. Description of Related Art

As a related art power source device for an image forming apparatus employs an electrophotographic method as described in such as Patent Document 1, a piezoelectric transformer has been known for generating the high voltage by an input of the low voltage using a resonance phenomenon of a piezoelectric vibrator and controlling the piezoelectric transformer using an output signal of a voltage-controlled oscillator (hereafter referred to as VCO) to output the high voltage.

Patent Document 1: Japanese Un-examined Patent Application Publication No. 2006-91757

Such a related art power source device, however, has various drawbacks as follows.

First, the related art power source device includes an analog circuitry, such as the VCO or the like, causing an increase in the number of its components.

Second, in a case where the high voltage output around resonant frequency of the piezoelectric transformer is used and where the output voltage is decreased by the load fluctuation, the output voltage cannot be controlled if the frequency of the output voltage is controlled to be lower than the resonant frequency. Consequently, the high voltage output around the resonant frequency cannot be substantially used.

Third, a time constant for controlling the output voltage needs to be selected according to a component constant. Consequently, the prioritization of rise time or leading edge time causes deterioration of the controllability around the resonant frequency. The prioritization of the controllability around the resonant frequency, on the other hand, causes prolongation of the rise time or leading edge time.

Finally, in a case where a control target voltage is relatively row, a circuit structure using an analog oscillator such as the VCO can be influenced by spurious frequency, causing difficulty of controlling the output voltage.

The present invention is proposed in consideration of the aforementioned conventional situations, and provides a power source device and an image forming apparatus including the power source device. According to the power source and the image forming apparatus of the present invention, a sequence generation unit generates an "N" number of sequences, in which each element has substantially the same occurrence rate, with respect to each switching of the pulse by synchronizing with the pulse, thereby capable of obtaining a stable high voltage output having good controllability by obtaining the pulse having low frequency resolving power even if the low frequency clock is divided. Moreover, the constant voltage control can be stably performed from the high voltage output being relatively low to the high voltage output being relatively high around the resonance frequency of the piezoelectric transformer. In addition, the power source and the image forming apparatus of the invention allow a wide output range, so that the output is performed regardless of the environment, thereby obtaining a stable image having substantially no uneven density or a horizontal line. Moreover, the device can be provided with digital circuits, and the number of components can be reduced.

BRIEF SUMMARY OF THE INVENTION

According to one aspect of the invention, a power source device includes: an oscillator generating a clock; a frequency division unit dividing the clock to output a pulse; a sequence generation unit generating an "N" number of sequences, in which each element has substantially the same occurrence rate, with respect to each switching of the pulse by synchronizing with the pulse; a frequency division ratio setting unit setting a frequency division ratio of the pulse; a switching element driven by the pulse; and a piezoelectric transformer outputting an alternating current high voltage from a secondary side thereof when a primary side thereof is intermittently applied with a voltage by the switching element. The generated sequence and the set frequency division ratio are compared to output the pulse of a fractional-M frequency and the pulse of a fractional-M+1 frequency. An average frequency division ratio of the pulse of the fractional-M frequency and the pulse of the fractional-M+1 frequency is determined by $(M\times\alpha)+(M+1)\times\beta/(\alpha+\beta)$, where the $\alpha$ represents the number of the pulses of the fractional-M frequency and the $\beta$ represents the number of the pulses of the fractional-M+1 frequency per unit time. The average frequency division ratio and the frequency division ratio become substantially equal to each other at a generation cycle of the sequence, and become approximated to each other in a period shorter than the sequence generation cycle.

According to another aspect of the present invention, an image forming apparatus capable of forming an image includes the power source device as described above.

Additional features and advantages of the present invention will be more fully apparent from the following detailed description of embodiments, the accompanying drawings and the associated claims.

BRIEF DESCRIPTION OF THE DRAWINGS

A more complete appreciation of the aspects of the invention and many of the attendant advantage thereof will be readily obtained as the same becomes better understood by reference to the following detailed description when considered in connection with the accompanying drawings, wherein.

DETAILED DESCRIPTION OF PREFERRED EMBODIMENTS

Figure 1:
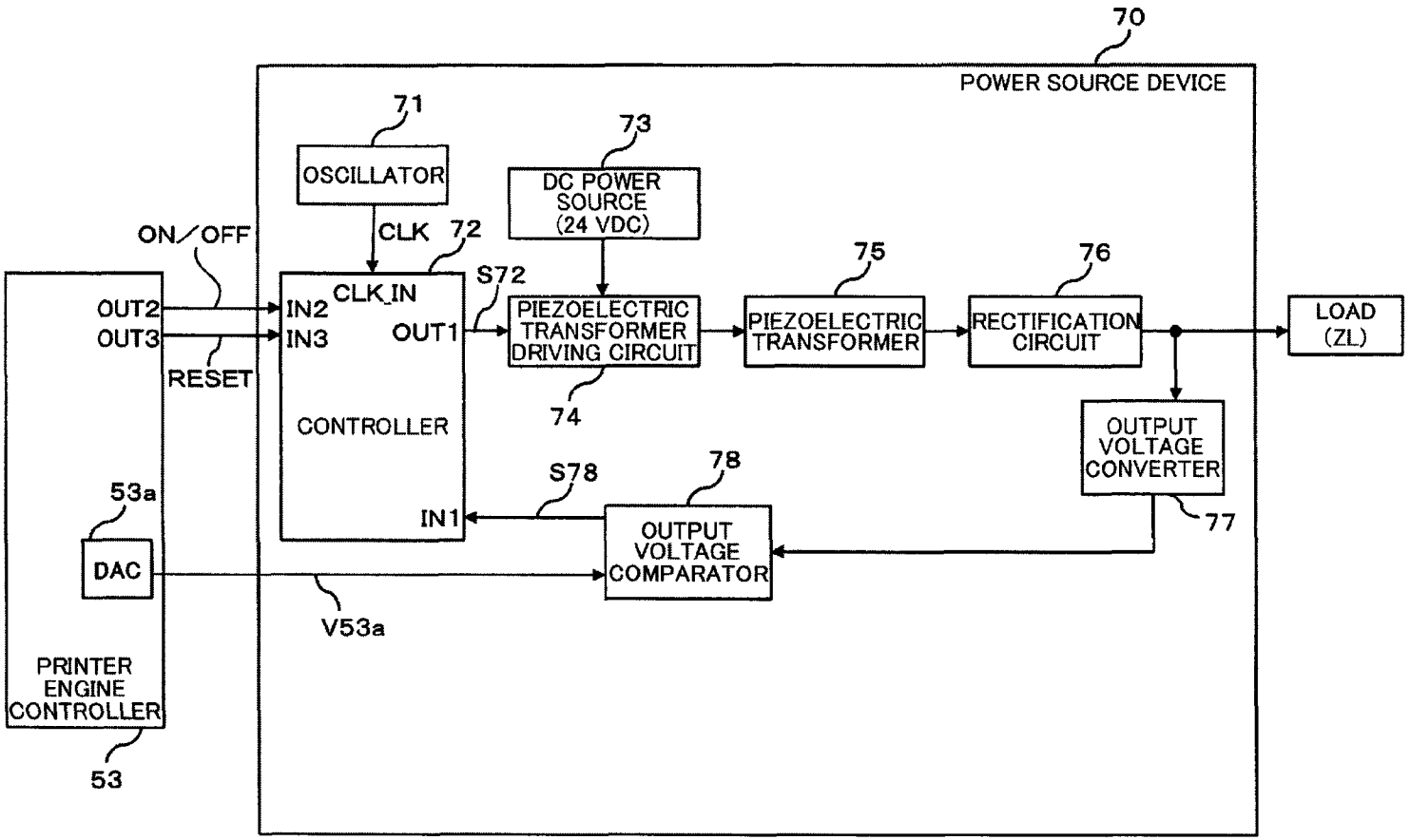
FIG. 1 is a schematic block diagram illustrating a power source device according to a first embodiment of the present invention.

In describing embodiments illustrated in the drawings, specific terminology is employed for the sake of clarity. However, the disclosure of this patent specification is not intended to be limited to the specific terminology so selected, and it is to be understood that each specific element includes all technical equivalents that operate in a similar manner. Referring now to the drawings, like reference numerals designate identical or corresponding parts throughout the several views.

First Embodiment

Figure 3:
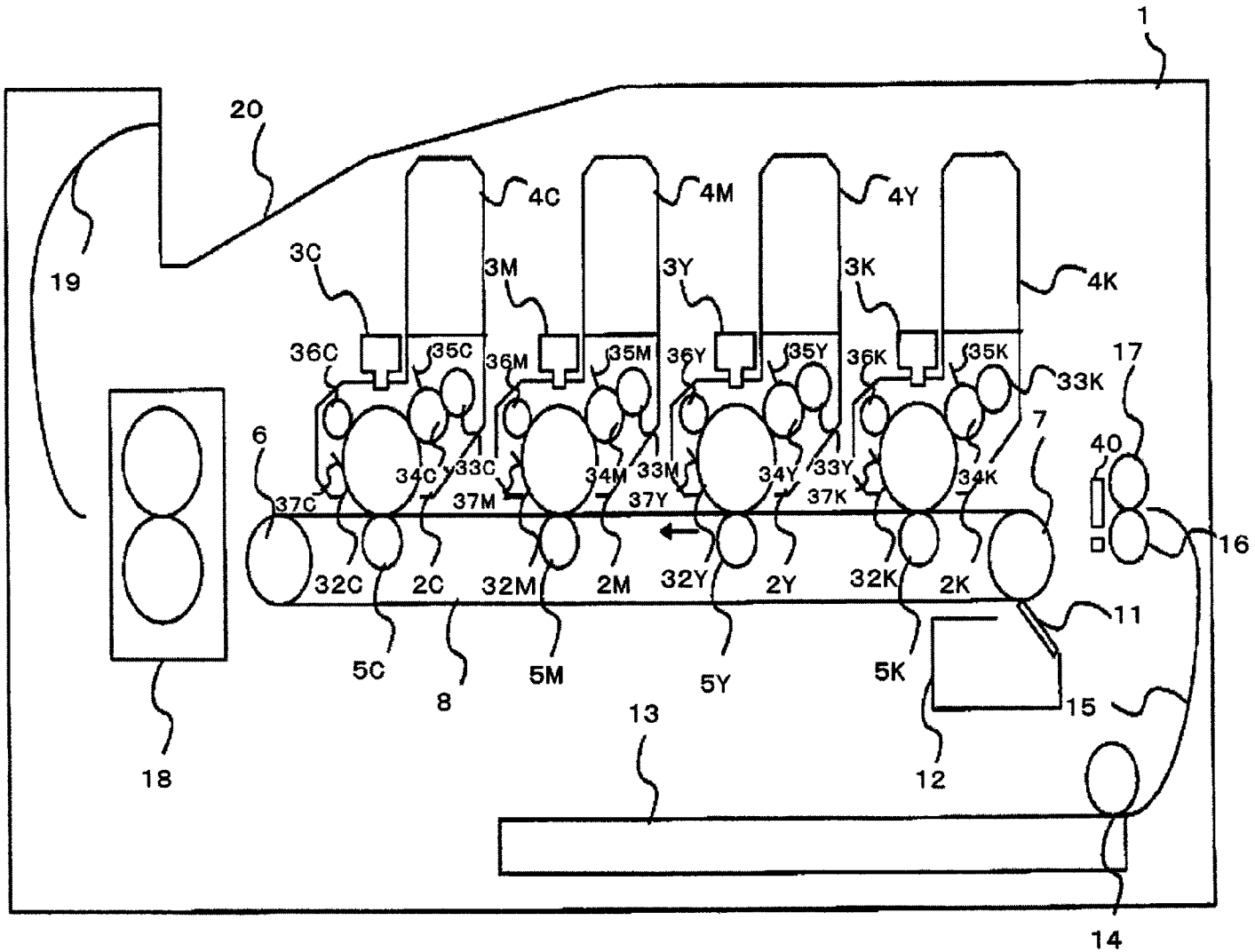
FIG. 3 is a schematic diagram illustrating an image forming apparatus including the power source device according to the first embodiment of the present invention.

Referring to FIG. 3, an image forming apparatus 1 including a power source device 70 according to a first embodiment of the present invention is illustrated in a schematic block diagram.

The image processing apparatus 1 is, for example, a multicolor image forming apparatus employing an electrophotographic method, and includes a black development device 2K, a yellow development device 2Y, a magenta development device 2M, and a cyan development device 2C detachably disposed thereto (K, Y, M, and C hereafter represent colors of black, yellow, magenta, and cyan, respectively). Photosensitive drums 32K, 32Y, 32M, and 32C are uniformly charged by respective charging rollers 36K, 36Y, 36M, and 36C contacting the respective photosensitive drums 32K, 32Y, 32M, and 32C. The charged photosensitive drums 32K, 32Y, 32M, and 32C form latent images thereon by light emitted from a black light emitting element (hereafter referred to as LED) head 3K, a yellow LED head 3Y, a magenta LED head 3M, and a cyan LED head 3C, respectively.

The development devices 2K, 2Y, 2M, and 2C include thereinside respective supply rollers 33K, 33Y, 33M, and 33C supplying toner to development rollers 34K, 34Y, 34M, and 34C, respectively. The development rollers 34K, 34Y, 34M, and 34C uniformly form toner layers on surfaces thereof by respective development blades 35K, 35Y, 35M, and 35C, so that toner images are developed on the respective photosensitive drums 32K, 32Y, 32M, and 32C. The development devices 2K, 2Y, 2M, and 2C include thereinside respective cleaning blades 37K, 37Y, 37M, and 37C removing residual toner from the photosensitive drums 32K, 32Y, 32M, and 32C after transfer operation.

A black toner cartridge 4K, a yellow toner cartridge 4Y, a magenta toner cartridge 4M, and a cyan toner cartridge 4C are detachably disposed to the respective development devices 2K, 2Y, 2M, and 2C, and capable of supplying the toner thereinside to the respective development devices 2K, 2Y, 2M, and 2C. A black transfer roller 5K, a yellow transfer roller 5Y, a magenta transfer roller 5M, and a cyan transfer roller 5C are disposed in such a manner that the bias can be applied to respective transfer nips from a backside of a transfer belt 8. A transfer belt driving roller 6 and a transfer belt driven roller 7 tightly stretch the transfer belt 8, so that a recording medium 15, for example, a sheet, is conveyed with rotation of the driving roller 6 and driven roller 7.

A transfer belt cleaning blade 11 scrapes the toner remained on the transfer belt 8, and the toner scraped from the transfer belt 8 by the transfer belt cleaning blade 11 is collected in a transfer belt cleaner container 12. A sheet cassette 13 is detachably disposed to the image forming apparatus 1 and stores the recording medium 15 serving as a transfer medium thereinside. A hopping roller 14 conveys the recording medium 15 from the sheet cassette 13. Registration rollers 16, 17 convey the recording medium 15 to the transfer belt 8 at a prescribed timing. A fixing device 18 fixes the toner image on the recording medium 15 by application of heat and pressure. A sheet guide 19 ejects the recording medium 15 on an ejection tray 20 with the recording medium 15 facing down.

A sheet detection sensor 40 is disposed in the vicinity of the registration rollers 16, 17, and detects passage of the recording medium 15 in a contact or a non-contact manner. The sheet detection sensor 40 determines a transfer bias application timing, at which the power source device 70 applies the transfer bias to perform the transfer operation by the transfer rollers 5K, 5Y, 5M, and 5C, based on a time determined by a relationship between a distance from a sensor position to the transfer nip and a sheet conveyance speed.

Figure 4:
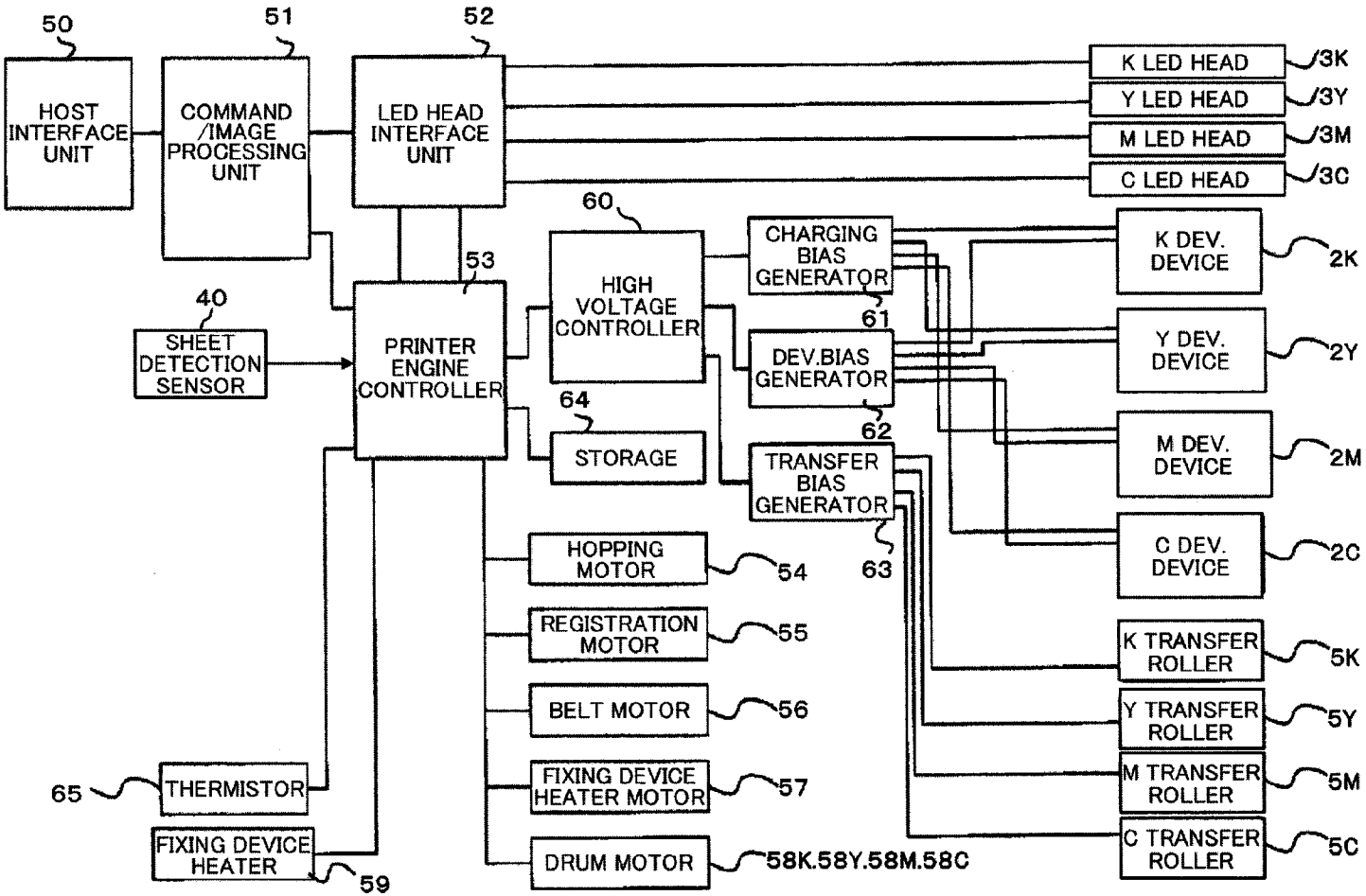
FIG. 4 is a schematic block diagram illustrating a control circuit included in the image forming apparatus of FIG. 3.

Referring to FIG. 4, a control circuit included in the image forming apparatus 1 of FIG. 3 is illustrated in a block diagram. The control circuit includes a host interface unit 50 transmitting and receiving data with respect to a command/image processing unit 51. The command/image processing unit 51 outputs image data with respect to a LED head interface unit 52. The LED head interface unit 52 allows the LED heads 3K, 3Y, 3M, and 3C to emit the light by controlling a head driving pulse and the like by a printer engine controller 53 in communication with storage 64.

The printer engine controller 53 receives a detection signal and the like from the sheet detection sensor 40 and transmits control values of a charging bias, a development bias, a transfer bias and the like with respect to a high voltage controller 60. The high voltage controller 60 transmits a signal to each of a charging bias generator 61, a development bias generator 62, and a transfer bias generator 63. Each of the charging bias generator 61 and the development bias generator 62 applies the bias with respect to the charging rollers 36K, 36Y, 36M, and 36C and the development rollers 34K, 34Y, 34M, and 34C of the respective development devices 2K, 2Y, 2M, and 2C. The high voltage controller 60 includes a controller 72 thereinside, and the controller 72 and the transfer bias generator 63 forms the power source device 70 according to the first embodiment of the present invention. A detailed description of the power source device 70 will be given later.

The printer engine controller 53 drives each of a hopping motor 54, a registration motor 55, a belt motor 56, a fixing device heater motor 57, and drum motors 58K, 58Y, 58M, and 58C at a prescribed timing. The printer engine controller 53 controls temperature of a fixing device heater 59 in response to a detection value detected by a thermistor 65.

Referring now to FIG. 1, the power source device 70 according to the first embodiment of the present invention is illustrated in a block diagram.

The power source device 70 includes the controller 72 included in the high voltage controller 60 and the transfer bias generator 63 of FIG. 4, and is disposed to each of the transfer rollers 5K, 5Y, 5M, and 5C. Since each of the power source devices 70 is substantially similar to one another except for the color of toner, a description of the power source devices 70 is hereafter given by using the power source device 70 having one set of the circuit as the representative of the power source devices 70.

The power source device 70 receives inputs of an ON/OFF signal supplied from an output port OUT 2 and a reset signal "RESET" supplied from an output port OUT 3 of the printer engine controller 53. The power source device 70 also receives an input of a first target voltage V53*a* output with a range of, for example, 3.3 V, from a variable voltage output circuit 53*a* serving as a first target voltage setting unit disposed inside the printer engine controller 53, thereby generating a direct current (hereafter referred to as DC) high voltage and supplying the DC high voltage to a load ZL serving as the transfer roller 5. The variable voltage output circuit 53*a* is, for example, a digital/analog converter (hereafter referred to as a DAC) having resolving power of 10-bit.

The power source device 70 includes an oscillator 71 generating a reference clock (hereafter referred to as a clock or abbreviated as CLK as necessary) of a constant frequency (e.g., 33.33 MH). The controller 72, serving as a circuit, is connected on the output side of the oscillator 71. For example, the controller 72, disposed inside the high voltage controller 60, operates by synchronization with the CLK supplied from the oscillator 71, and outputs a piezoelectric transformer driving pulse (hereafter referred to as a driving pulse) S72 by being controlled by the printer engine controller 53. The controller 72 includes: a clock input port CLK_IN receiving an input of the CLK; an input port IN1 receiving an input of a comparison result S78 (described later); an input port IN2 receiving an input of the ON/OFF signal output from the output port OUT2 of the printer engine controller 53; a reset input port IN3 receiving an input of the reset signal "RESET" output from the output port OUT3 of the printer engine controller 53; and an output port OUT1 outputting the driving pulse S72 therefrom. The input of the ON/OFF signal to the input port IN2 allows ON/OFF switching for outputting the driving pulse S72 from the output port OUT1 to be controlled. The input of the reset signal "RESET" to the input port IN3 allows an output setting with respect to the output port OUT1 to be initialized. The input of the reset signal "RESET" to the reset input port IN3 may be omitted by inputting an ON-RESET signal serving as a combination of ON and RESET signals to the input port IN2. That is, the ON-RESET signal may be input to the input port IN2 instead of the ON/OFF signal.

The controller 72, for example, includes; an application specific integrated circuit (hereafter referred to as an ASIC) serving as an integrated circuit integrating a plurality of functions for specific purposes in one; a microprocessor including a built-in central processing unit (hereafter referred to as a CPU); or a field programmable gate array (hereafter referred to as an FPGA) serving as one of gate arrays capable of allowing a user to write a logical circuit of own.

The output port OUT1 of the controller 72 and a direct current power source or DC power source 73 outputting the DC having a voltage of 24 V (hereafter abbreviated as DC 24 V) are connected with a piezoelectric transformer driving circuit 74. The piezoelectric transformer driving circuit 74 outputs a driving voltage using a switching element, and a piezoelectric transformer 75 is connected on an output side of the piezoelectric transformer driving circuit 74. The piezoelectric transformer 75, serving as a transformer, increases the driving voltage using a resonance phenomenon of a piezoelectric vibrator of, for example, the ceramics and outputs an alternating current (hereafter referred to as an AC) high voltage. A rectifier (e.g., a rectification circuit) 76 is connected on the output side of the piezoelectric transformer 75. The rectifier 76, serving as a circuit, converts the AC high voltage output from the piezoelectric transformer 75 into the DC high voltage and supplies to the load ZL. An output voltage conversion unit (hereafter referred to as an output voltage converter) 77 is connected on the output side of the rectifier 76.

The output voltage converter 77, serving as a circuit, converts the DC high voltage into a low voltage. An output voltage comparator 78, serving as a comparison unit, is connected on the output side of the output voltage converter 77. The output voltage comparator 78 compares the DC low voltage output from the output voltage converter 77 and the target voltage V53*a* output from the DAC 53*a* of the printer engine controller 53 to obtain the comparison result S78, and inputs the comparison result S78 to the input port IN1 of the controller 72.

The power source device 70 is disposed with respect to each of the transfer rollers 5K, 5Y, 5M, and 5C. That is, the power source device 70 is juxtaposed with respect to each of plural channels. However, the power source device 70 may have a portion thereof being shared among the plural channels. For example, the piezoelectric transformer 75 and the rectifier 76 need the plural channels. However, the oscillator 71 and the controller 72 may share one set of the channels. In such a case, the controller 72 may include an input-output port or ports corresponding to the number of channels. The controller 72 is disposed inside the power source device 70. However, the controller 72 may be disposed inside a large-scale integrated circuit (hereafter referred to as an LSI) in the printer engine controller 53.

Figure 2:
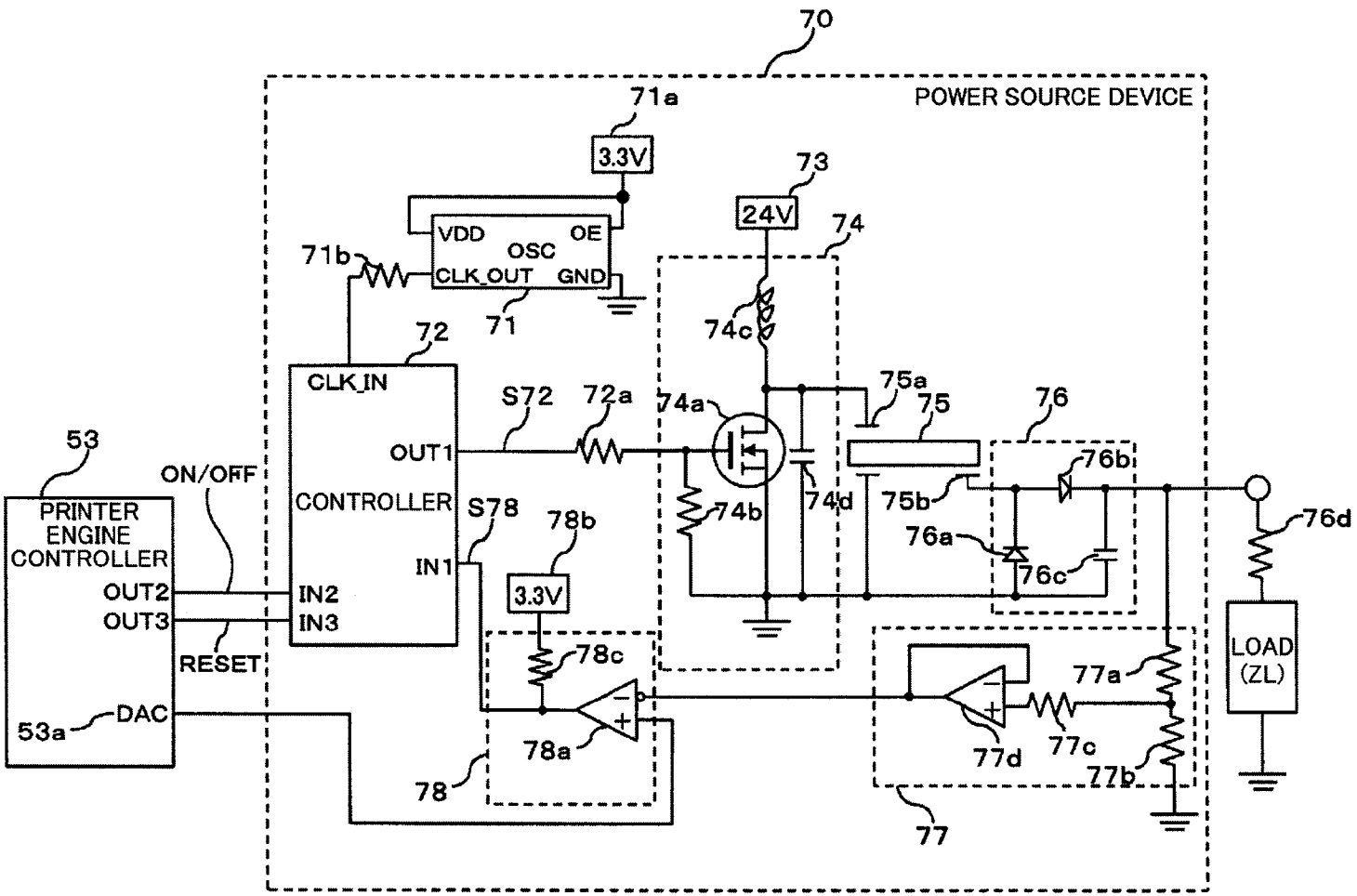
FIG. 2 is a circuit diagram illustrating the power source device of FIG. 1 in detail.
Figure 5:
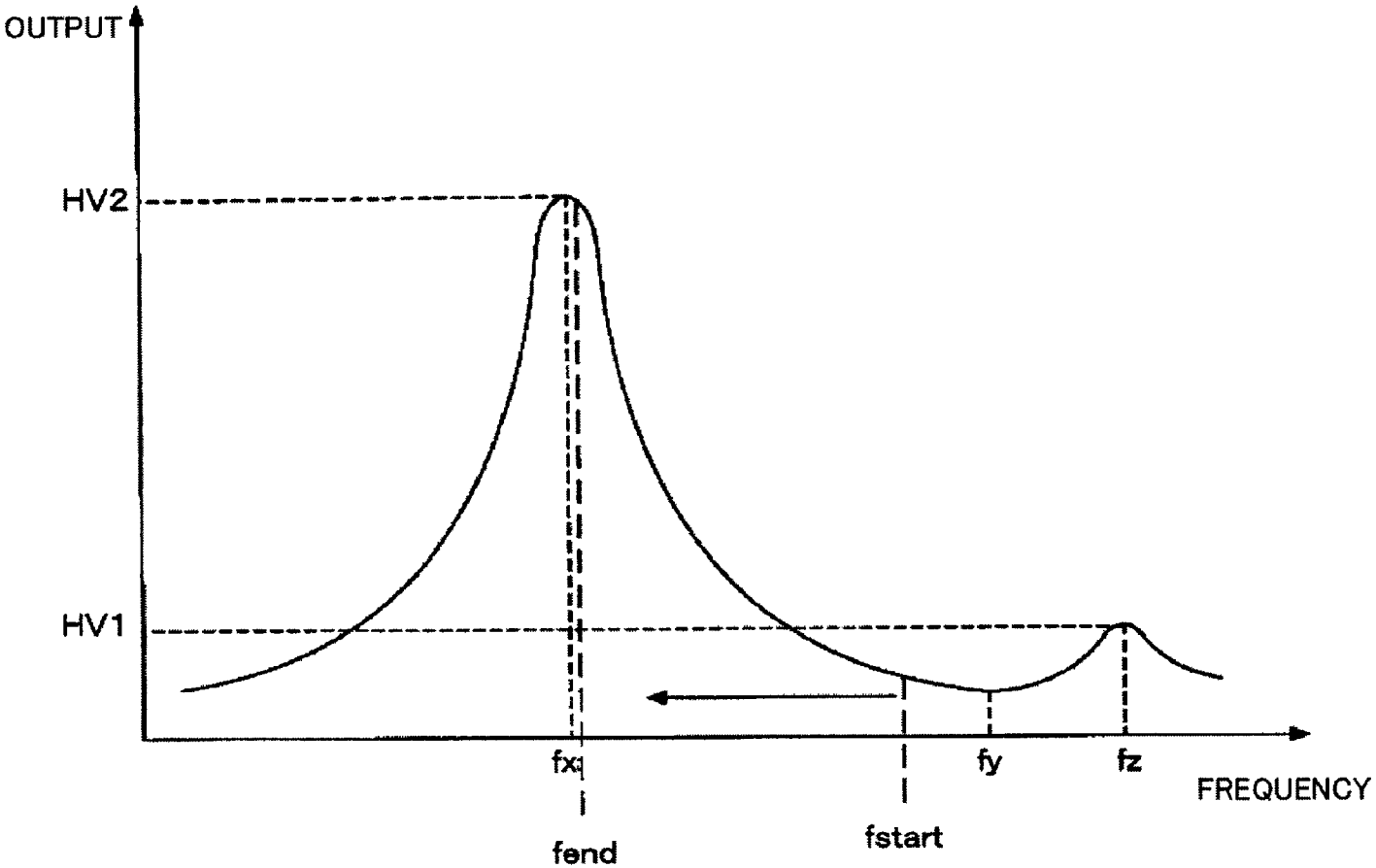
FIG. 5 is a schematic characteristic diagram illustrating a relationship between an output voltage and frequency in a piezoelectric transformer included in the power source device of FIG. 2.

Referring to FIG. 2 and FIG. 5, the power source device 70 of FIG. 1 is illustrated in detail in a circuit diagram, and a relationship between the output voltage and frequency in the piezoelectric transformer 75 in the power source device 70 of FIG. 2 is illustrated in a characteristic diagram, respectively. The oscillator 71, serving as a circuit, generates the CLK running at the oscillation frequency of 33.33 MHz in response to the DC having a voltage of 3.3 V (hereafter abbreviated as DC 3.3 V) supplied from a power source 71*a*. The oscillator 71 includes: a power source terminal VDD applied with the DC 3.3 V; an output enable terminal OE applied with the DC 3.3 V; a clock output terminal CLK_OUT outputting the CLK therefrom; and a ground terminal GND. The clock output terminal CLK_OUT is connected to the clock input port CLK_IN of the controller 72 through a resistance 71*b*.

The controller 72 operates by synchronization with the CLK, and the output port OUT1 included in the controller 72 is connected with the piezoelectric transformer driving circuit 74 through a resistance 72*a* to output the driving pulse S72 therefrom. The piezoelectric transformer driving circuit 74 is connected with the DC power source 73. Herein, the DC power source 73, for example, is a power source supplying a DC 24 V by the rectifying transformation of the AC having a voltage of 100 V (hereafter abbreviated as AC 100 V) serving as a commercial power source from a low voltage power source device (not shown).

The piezoelectric transformer driving circuit 74 includes a power transistor 74*a* serving as the switching element. The power transistor 74*a* is, for example, an N-channel power metal-oxide-semiconductor field-effect transistor (hereafter referred to as an NMOS). The NMOS 74*a* has a gate and a source between which a resistance 74*b* for use in short-circuit prevention is connected. The NMOS 74*a* has a drain connected to the DC power source 73 having the DC 24 V through an inductor (coil) 74*c*, and has the drain and the source between which a capacitor 74*d* is connected in parallel. The capacitor 74*d* and the inductor 74*c* form a resonance circuit. In a case where the driving pulse S72 is input to the gate of the NMOS 74*a* from the controller 72, the NMOS 74*a* allows the DC 24 V to be switched, thereby resonating by the resonance circuit to output the driving voltage of a sine wave having a peak of approximately AC 100 V.

The resonance circuit has an output side connected with an input terminal 75*a* provided on the primary side of the piezoelectric transformer 75, and the AC high voltage between 0 (zero) and several kV is output from an output terminal 75*b* provided on the secondary side of the piezoelectric transformer 75 in response to a switching frequency of the NMOS 74*a*. The output terminal 75*b* on the secondary side has an output voltage characteristic as illustrated in FIG. 5. The output voltage characteristic varies depending on the frequency, and a boost ratio is determined by the switching frequency of the NOMS 74*a*.

The piezoelectric transformer 75 obtains a maximum boost ratio at a frequency "fx" and a minimum boost ratio around a frequency "fy" as illustrated in FIG. 5. A frequency "fz" in the characteristic diagram of FIG. 5 represents a spurious frequency. According to the first embodiment of the present invention, the frequency is controlled in a range from a start frequency "fstart" to a frequency "fend." Herein, the start frequency "fstart" is lower than the spurious frequency "fz," and the frequency "fend" is higher than the resonance frequency "fx."

The piezoelectric transformer 75 has the secondary side having the output terminal 75*b* connected with the rectifier 76 for AC/DC conversion. The rectifier 76 converts the AC high voltage output from the output terminal 75*b* on the secondary side of the piezoelectric transformer 75 into the DC high voltage and outputs the DC high voltage. The rectifier 76 includes diodes 76*a*, 76*b* and a capacitor 76*c*. The rectifier 76 has an output side connected with the output voltage converter 77 and the load ZL serving as the transfer roller 5 through a resistance 76*d*.

The output voltage converter 77 includes: division resistances 77*a*, 77*b* dividing the DC high voltage of the rectifier 76 so as to convert into a low voltage (e.g., a voltage lower than DC 3.3 V); and a voltage follower circuit including an operational amplifier 77*d* receiving an inputs of the low voltage through a protective voltage 77*c*. For example, the division resistances 77*a* and 77*b* have resistance values of 200 MΩ and 100 kΩ, respectively, and the DC high voltage output from the rectifier 76 is divided into 1/2001. The Operational amplifier 77*d* is applied with the voltage of 24 V from the DC power source 73, and the voltage follower circuit including the Operational amplifier 77*d* has the output side connected with the output voltage comparator 78.

The output voltage comparator 78 includes: a comparator 78*a*, serving as a voltage comparator, applied with the voltage of 24 V from the DC power source 73; and a power source 78*b*, having the voltage of DC 3.3 V, pulling up an output terminal of the comparator 78*a* and a pull-up resistance 78*c*. The comparator 78*a* includes: an input terminal "−" or negative input terminal receiving an input of the output voltage of the voltage follower circuit; and an input terminal "+" or positive input terminal receiving an input of the target voltage V53*a* output from the DAC 53*a* in the printer engine controller 53. The comparator 78*a* compares the voltages of the negative and positive input terminals, and outputs the comparison result S78 from an output terminal thereof, so that the comparison result S78 is supplied to the input port IN1 of the controller 72. The comparator 78*a* has the output terminal connected to the power source 78*b* having the voltage of DC 3.3 V through the pull-up resistance 78*c*.

The DAC 53*a*, disposed inside the printer engine controller 53, has the resolving power of 10-bit and outputs the target voltage V53*a* with the range of, for example, 3.3 V, so that the target voltage V53*a* is input to the positive input terminal of the comparator 78*a*. Subsequently, the comparator 78*a* compares the output voltage of the output voltage converter 77 and the target voltage V53*a*. While the target voltage V53*a* is being greater than the output voltage of the output voltage converter 77 based on the comparison, the output terminal of the comparator 78*a* is pulled up by the power source 78*b* having the DC 3.3 V and the resistance 77*c*, thereby having the DC 3.3 V (that is, a high level which is hereafter abbreviated as an "H"). The "H" is input to the input port N1 of the controller 72. Where the target voltage V53*a* is lower (i.e., when the target voltage V53*a* becomes lower) than the output voltage of the output voltage converter 77, on the other hand, the output terminal of the comparator 78*a* becomes a low level (hereafter abbreviated as an "L"), and the "L" is input to the input port N1 of the controller 72.

Figure 6:
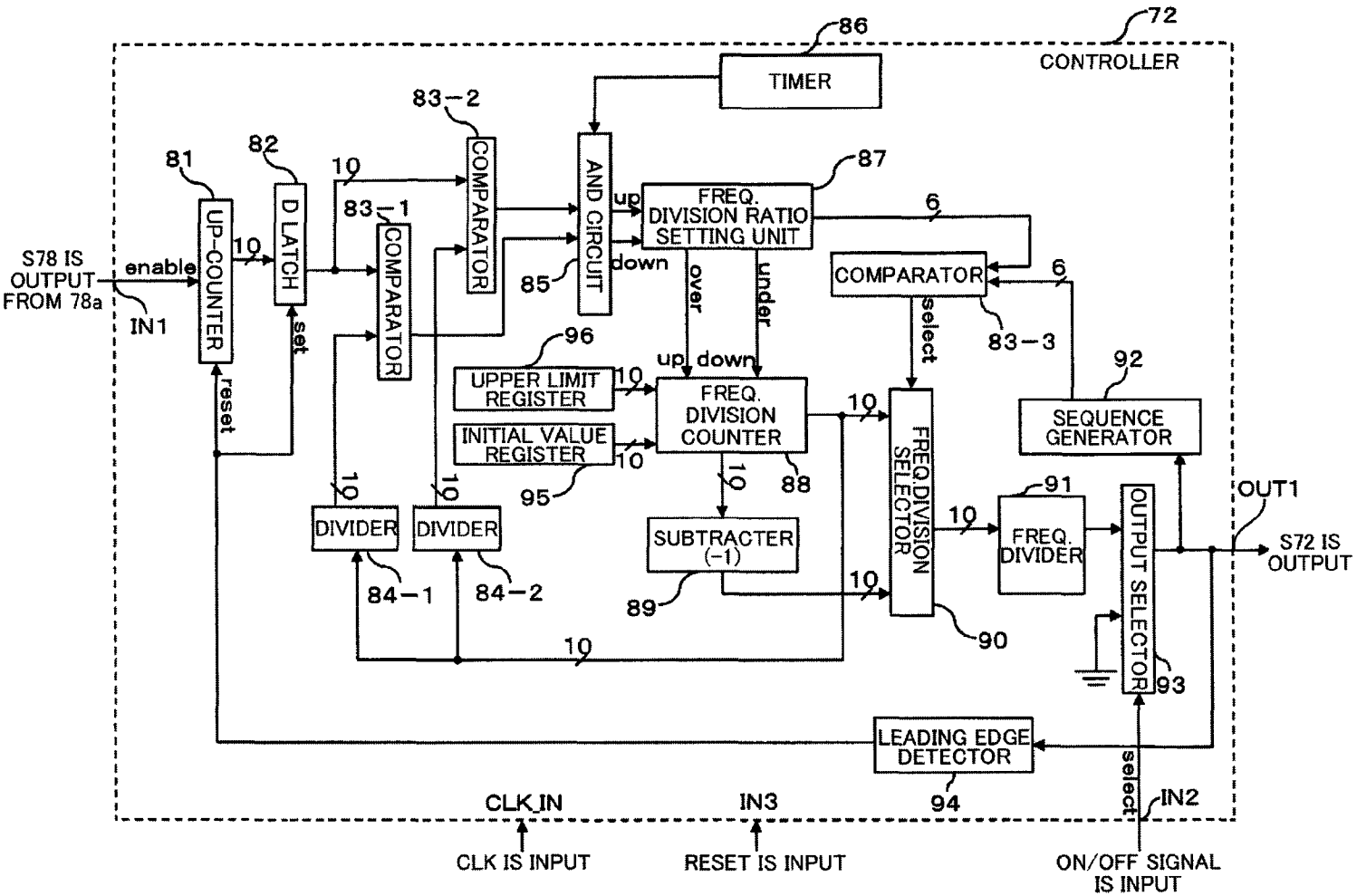
FIG. 6 is a schematic diagram illustrating a controller included in the power source device of FIG. 2.

Referring to FIG. 6, the controller 72 of FIG. 2 is illustrated in detail.

The controller 72, for example, includes the ASIC and is written in a hardware description language. Among the CLK and the reset signal "RESET" to be input to the controller 72, the CLK is supplied to each of block circuits (described later) having a synchronization circuit, and the reset signal RESET is supplied to each of the block circuits for initialization.

The controller 72 includes an up-counter 81 connected to the input port IN1. The up-counter 81 begins to operate using the comparison result S78 having the "H" level output from the comparator 78*a* as an enable signal, and serves as a 10-bit counter counting up with a leading edge pulse of the CLK. While the comparison result S78 is being the "L" level, the up-counter 81 does not count up. The up-counter 81 operates only when the comparison result S78 is the "H" level. The up-counter 81 is reset to zero (0) by a rising input (e.g., a RESET e signal) of one (1) clock pulse of a leading edge detector 94. Similarly, the up-counter 81 is cleared to zero (0) by an input of the "L" of the reset signal "RESET" supplied from the printer engine controller 53, and halts the count operation while the "L" is being held. The up-counter 81 outputs a 10-bit output signal to a data latch (hereafter referred to as a D-latch) 82.

The D-latch 82 holds the 10-bit output signal of the up-counter 81 using an input of the rising signal (e.g., a "set" signal) of the one (1) clock pulse output from the leading edge detector 94, and outputs a value of the 10-bit signal held thereby to first and second comparators 83-1, 83-2, so that the value of the 10-bit signal is cleared to zero (0) by the "L" of the reset signal "RESET" to be input. The first comparator 83-1 compares the output signal of the D-latch 82 and an output signal of a first divider 84-1 with respect to each leading edge of the CLK. Where the output signal of the D-latch 82 is lower than that of the first divider 84-1, the first comparator 83-1 outputs the "L" level to a logical conjunction (hereafter referred to as an AND) circuit 85. Where the output signal comparison of the D-latch 82 and the first divider 84-1 is different from the above, on the other hand, the first comparator 83-1 outputs the "H" level to the AND circuit 85. The second comparator 83-2 compares the output signal of the D-latch 82 and the output signal of the divider 84-2. Where the output signal of the D-latch 82 is greater than that of the divider 84-2, the second comparator 83-2 outputs the "L" level to the AND circuit 85. Where the output signal comparison of the D-latch 82 and the second divider 84-2 is different from the above, on the other hand, the second comparator 83-2 outputs the "H" level to the AND circuit 85.

The first divider 84-1 shifts the 10-bit output signal of a frequency division counter 88 to the right by one (1) bit (that is, division) with respect to each leading edge of the CLK, thereby inputting zero (0) in the highest-order bit. In other words, the lowest-order bit is rounded down, and a value of the frequency division counter 88 is reduced to ½ so as to output to the first comparator 83-1. The second divider 84-2 shifts the 10-bit output signal of the frequency division counter 88 to the right by two (2) bits (that is, division) with respect to each leading edge of the CLK, thereby inputting zero (0) in the 2 bits from the lowest-order bit. In other words, the lowest-order 2 bits are rounded down, and a value of the frequency division counter 88 is reduced to ¼ so as to output to the second comparator 83-2.

A timer (e.g., a frequency divider) 86 outputs a pulse of one (1) clock with respect to each 1280H cycle (that is, 4736 cycles, 142.08 μsec). Herein, the one clock represents an input clock from the CLK output from the oscillator 71. The one clock has the output signal of the "H" to be input to the AND circuit 85.

The AND circuit 85 implements a logical conjunction (also referred to as an AND) of at least one of the output signals of the first and second comparators 83-1, 83-2 and the output signal of the timer 86, and outputs to a frequency ratio setting unit (e.g., a 6-bit counter) 87. For example, where the second comparator 83-2 has the output signal having the "H" level, the AND circuit 85 implements the logical conjunction or summation of the pulse of the timer 86 and the output signal of the second comparator 83-2, and outputs a count-up pulse "up" to the 6-bit counter 87. Where the first comparator 83-1 has the output signal having the "H" level, the AND circuit 85 implements the logical conjunction of the pulse of the timer 86 and the output signal of the first comparator 83-1, and outputs a count-down pulse "down" to the 6-bit counter 87. One of the output signals of the first comparator 83-1 and the second comparator 83-2 is the "H" level, or both of the output signals are the "L" according to the above logic.

The 6-bit counter 87 is cleared to zero (0) when the "L" of the reset signal "RESET" is input. In a case where the AND circuit 85 outputs the "H" based on the logical conjunction of the timer 86 and the second comparator 83-2 by synchronization with the rising clock, the 6-bit counter 87 is counted up by +1. In a case where the AND circuit 85 outputs the "H" based on the logical conjunction of the first comparator 83-1 and the timer 86, the 6-bit counter 87 is counted down by −1. The 6-bit counter 87 has a count value to be output to a third comparator 83-3. Moreover, in a case where the value of the 6-bit counter 87 is changed from "11111b" to "00000b" in the course of counting, the 6-bit counter 87 outputs an over flow signal "over" having the "H" level with respect to the frequency division counter 88. In a case where the value of the 6-bit counter 87 is changed from "00000b" to "11111b" in the course of counting down, on the other hand, the 6-bit counter 87 outputs an under flow signal "under" having the "H" level with respect to the frequency division counter 88.

The frequency division counter 88 is set by an initial value register 95 in a case where the reset signal "RESET" is the "L" level. The frequency division counter 88 counts up at a timing at which the leading edge of the over flow signal "over" is provided, and counts down at a timing at which the leading edge of the under flow signal "under" is provided. For example, the values of the frequency division counter 88 and the upper limit register 96 are compared. Where the values of the frequency division counter 88 and the upper limit register 96 are not equal, the frequency division counter 88 counts up. The values of the frequency division counter 88 and the initial value register 95 are compared. Where the values of the frequency division counter 88 and the initial value register 95 are not equal, the frequency division counter 88 counts down. The frequency division counter 88 has the value to be output to the first divider 84-1, the second divider 84-2, a frequency division selector 90, and a subtractor 89.

The initial value register 95 serves as a 10-bit register, and outputs the 10-bit signal to the frequency division counter 88. The upper limit register 96 serves as a 10-bit register, and outputs the 10-bit signal to the frequency division counter 88. Each of the registers 95, 96 holds a certain value. The subtractor 89 outputs the value, calculated by subtracting 1 (that is, +(−1)) from the 10-bit output signal of the frequency division counter 88, to the frequency division selector 90. In a case where the a selection signal "select" to be output from the third comparator 83-3 is the "L" level, the frequency division selector 90 outputs the 10-bit value of the frequency division counter 88 to a frequency division unit (e.g., a frequency divider) 91. In a case where the selection signal "select" is the "H" level, on the other hand, the frequency division selector 90 outputs the 10-bit value of the subtractor 89 to the frequency divider 91.

The frequency divider 91 includes a 10-bit counter counting up at a timing of rising the CLK. The frequency divider 91 compares a 10-bit output value from the frequency division selector 90 and a value (described below) provided by reducing the 10-bit output value to approximately 30 percent. Particularly, the 30 percent value is calculated by adding values of ¼, 1/32, and 1/64 of the 10-bit output value. That is, the 10-bit output value from the frequency division selector 90 is shifted to the right by 2-bit, 5-bit, and 6-bit. Where the 10-bit output value of the frequency division selector 90 is equal to the 30 percent value, the frequency divider 91 allows an output thereof to be the "L" level. Where the 10-bit output value of the frequency division selector 90 is equal to the output value of the frequency division selector 90, the frequency divider 91 allows the output thereof to be the "H" level and a counter thereinside to be cleared to zero (0). Accordingly, the frequency divider 91 outputs an ON-duty pulse of approximately 30 percent using the frequency provided by dividing the CLK by the output value of the frequency division selector 90.

According to the first embodiment of the present invention, the CLK running at the frequency of 33.33 MHz is divided to approximately 110 to 130 kHz serving as a piezoelectric transformer driving frequency, and the frequency division ratio becomes a range from approximately 256 to 303, thereby having the duty between 29.3 and 30.0 percent. In a case where the duty is changed within the range, the circuit according to the first embodiment is rarely influenced by the shift of the output voltage. According to the first embodiment, the addition of the shift values is used as an arithmetic example of one cycle. However, since the frequency division pulse is a level of 100 kHz which is relatively low with respect to the operation frequency of 33.33 MHz, arithmetic operation may be applied to obtain an accurate value for the 30 percent.

An output selector 93 selects the output signal of the frequency divider 91 and outputs to the output port OUT 1 as the driving pulse S72 in a case where the printer engine controller 53 outputs the ON/OFF signal having the "H" level. The output selector 93 selects a ground potential having the "L" level and outputs to the output port OUT1 as the driving pulse S72 in a case where the printer engine controller 53 outputs the ON/OFF signal having the "L" level. The frequency divider 91 outputs the pulse with the frequency division ratio of the initial value after resetting. However, the frequency divider 91 does not output the driving pulse while the ON/OFF signal from an external unit is being OFF.

A sequence generation unit (e.g., a 6-bit sequence generator) 92 outputs a sequence to the third comparator 83-3 at a timing at which the leading edge of the driving pulse S72 output from the output selector 93 is provided. The sequence includes element each of which has substantially the same occurrence rate at 64 cycles. The third comparator 83-3 compares the output value of the 6-bit sequence generator 92 and the output value of the 6-bit counter 87. Where the output value of the 6-bit counter 87 is greater than that of the 6-bit sequence generator 92, the third comparator 83-3 outputs the selection signal "select" having the "L" level to the frequency division selector 90. Where the output comparison of the 6-bit sequence generator 92 and the 6-bit counter 87 is different from the above, on the other hand, the third comparator 83-3 outputs the selection signal "select" having the "H" level to the frequency division selector 90.

Upon detecting the leading edge of the driving pulse S72 output from the output selector 93, the leading edge detector 94 outputs the pulse of one clock delayed by one cycle relative to the leading edge. Herein, the pulse is output as the reset signal "reset" of the up-counter 81 or the set signal "set" of the D-latch 82.

Figure 7:
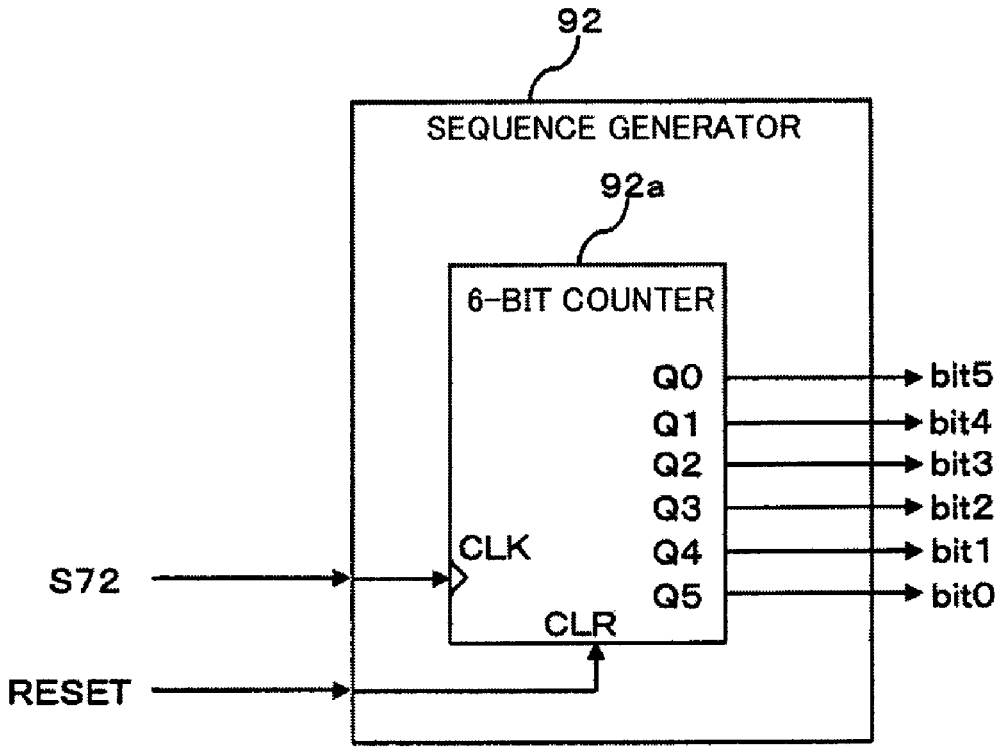
FIG. 7 is a schematic diagram illustrating a sequence generation unit included in the controller of FIG. 6.

Referring to FIG. 7, the 6-bit sequence generator 92 included in the controller 72 of FIG. 6 is illustrated. The 6-bit sequence generator 92 includes a count unit (e.g., a 6-bit counter) 92*a* therein. The 6-bit counter 92*a* is cleared to zero (0) by the reset signal "RESET" input to a clear terminal CLR. The 6-bit counter 92*a* counts the driving pulse S72 output from the output selector 93 upon receiving the inputs the driving pulse S72 from a CLK input terminal thereof, and outputs the count value to output terminals Q0 to Q5. The 6-bit sequence generator 92 reverses a bit arrangement of the high-low order with respect to the output signals of each of the output terminals Q0 to Q5, and outputs the bit 5 to bit 0 of the reverse sequence to the third comparator 83-3.

The controller 72 of FIG. 6 includes the ASIC. However, the controller 72 may be formed as a module having the FPGA or a microprocessor.

A description is now given of the operation of the image forming apparatus 1 as a whole according to the first embodiment of the present invention with reference to FIG. 3 and FIG. 4. In a case where the image forming apparatus 1 receives an input of print data written in, for example, a page description language (hereafter referred to as a PDL) from an external device (not shown) through the host interface unit 50, the command/image processing unit 51 converts the print data into bit-map data (e.g., image data) and transmits the bit-map data to the printer engine controller 53 and the LED head interface unit 52. The printer engine controller 53 controls the heater 59 disposed inside the fixing device 18 in response to the detection value of the thermistor 65, so that the heat fixing roller of the fixing device 18 becomes a prescribed temperature, thereby beginning the printing operation.

The recording medium 15 stored in the sheet cassette 13 is fed by the hopping roller 14, and is conveyed on the transfer belt 8 by the registration rollers 16, 17 at a timing synchronization with the image forming operation. The development devices 2K, 2Y, 2M, and 2C form the toner images on the respective photosensitive drums 32K, 32Y, 32M, and 32C using the electrophotographic process. Herein, each of the LED heads 3K, 3Y, 3M, and 3C is turned on in response to the bit-map data. The toner images are developed by the respective development devices 2K, 2Y, 2M, and 2C and are transferred to the recording medium 15 conveyed on the transfer belt 8 using the DC bias having the high voltage applied to the respective transfer rollers 5K, 5Y, 5M, and 5C from the power source device 70. After the toner images of four colors are transferred to the recording medium 15, the fixing device 18 fixes the toner images. Subsequently, the recording medium 15 having the toner images fixed thereon is ejected.

A description is given of the operation of the power source device 70 of FIG. 1.

According to the image forming apparatus 1 serving as the multi-color image forming apparatus of the first embodiment, the power source devices 70 are disposed to the respective transfer rollers 5K, 5Y, 5M, and 5C each of which performs the transfer operation (i.e., four times of the transfer operation). Since each of the power source devices 70 is substantially similar to one another except for the color of toner, a description of the operation of the power source devices 70 is hereafter given by using the power source device 70 as representative of the power source devices 70.

The DAC 53*a*, having the resolving power of 10-bit, is disposed inside the printer engine controller 53, and outputs the target voltage V53*a* to the output voltage comparator 78 of the power source device 70, thereby setting the DC high voltage to be output from the power source device 70. For example, where the DC high voltage is 5 kV, the target voltage V53*a* is 2.5 V. That is, since the DAC 53*a* has the resolving power of 10-bit, a value of 307H is set by a hexadecimal notation conversion, and the DAC 53*a* outputs the target voltage V53*a* of the 2.5 V to the output voltage comparator 78. Herein, the printer engine controller 53 allows the ON/OFF signal output from the output port OUT2 to the controller 72 to be OFF, and allows the reset signal "RESET" to be output to the controller 72 from the output port OUT3, so that the controller 72 is reset.

The controller 72 outputs the driving pulse S72 provided by dividing the frequency of the CLK output from the oscillator 71 to the piezoelectric transformer driving circuit 74 according to the ON/OFF signal from the printer engine controller 53. The controller 72 changes the frequency division ratio according to a state of the comparison result S78 input from the output voltage comparator 78. The piezoelectric transformer driving circuit 74 generates the driving voltage by switching the DC 24 V supplied from the DC power source 73 using the driving pulse S72 and supplies to the primary side of the piezoelectric transformer 75. Therefore, the primary side of the piezoelectric transformer 75 is driven, so that the AC high voltage is output from the secondary side. The rectifier 76 rectifies the AC high voltage, thereby supplying the DC high voltage to the load ZL serving as the transfer roller 5.

The output voltage converter 77 converts the DC high voltage output from the rectifier 76 into the voltage of 1/2001, for example, and supplies to the output voltage comparator 78. The output voltage comparator 78 compares the target voltage V53*a* from the DAC 53*a* and the output voltage of the output voltage converter 77, and supplies the comparison result S78 to the controller 72. Where the output voltage of the output voltage converter 77 is lower than that of the target voltage V53*a*, the printer engine controller 53 outputs the ON/OFF signal having the "H" level at a TTL level. Where the output voltage of the output voltage converter 77 is greater than that of the target voltage V53*a*, the printer engine controller 53 outputs the ON/OFF signal having the "L" level.

Where the output voltage of the output voltage converter 77 is substantially similar to that of the target voltage V53*a*, the output voltage converter 77 has the output voltage having a ripple (e.g., an AC component) remained therein although the rectifier 76 rectifies the AC high voltage on the secondary side of the piezoelectric transformer 75. Since the target voltage V53*a* output from the DAC 53*a* is the DC voltage substantially stabilized, the output voltage comparator 78 outputs a rectangular wave substantially synchronized with the driving pulse S72 input to the piezoelectric transformer driving circuit 74.

Figure 8:
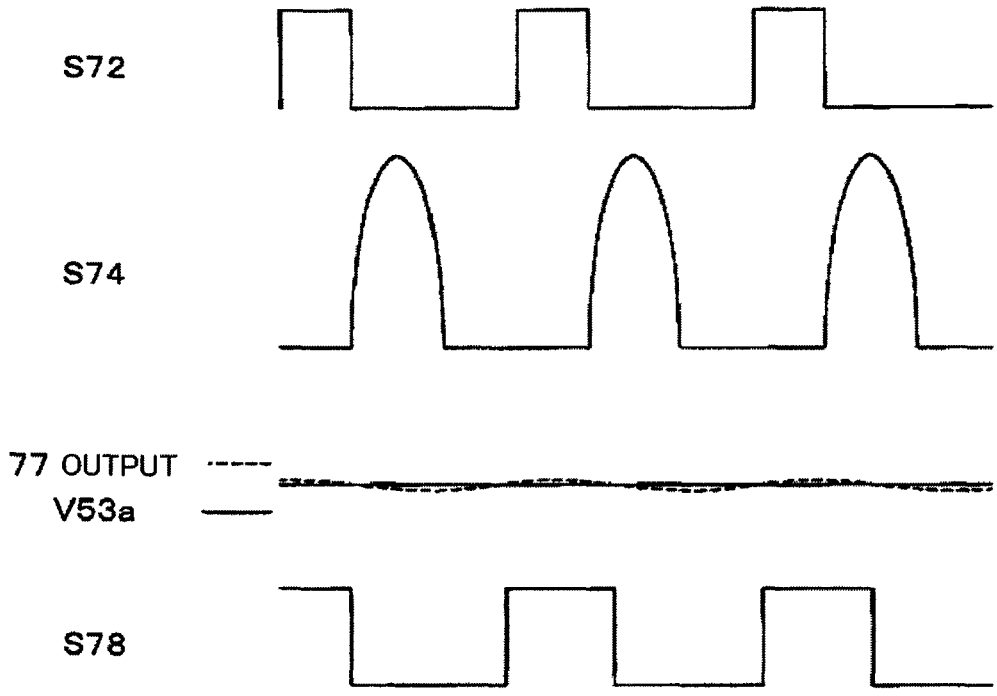
FIG. 8 is a schematic waveform diagram illustrating operation of the power source device of FIG. 2.
Figure 9A:
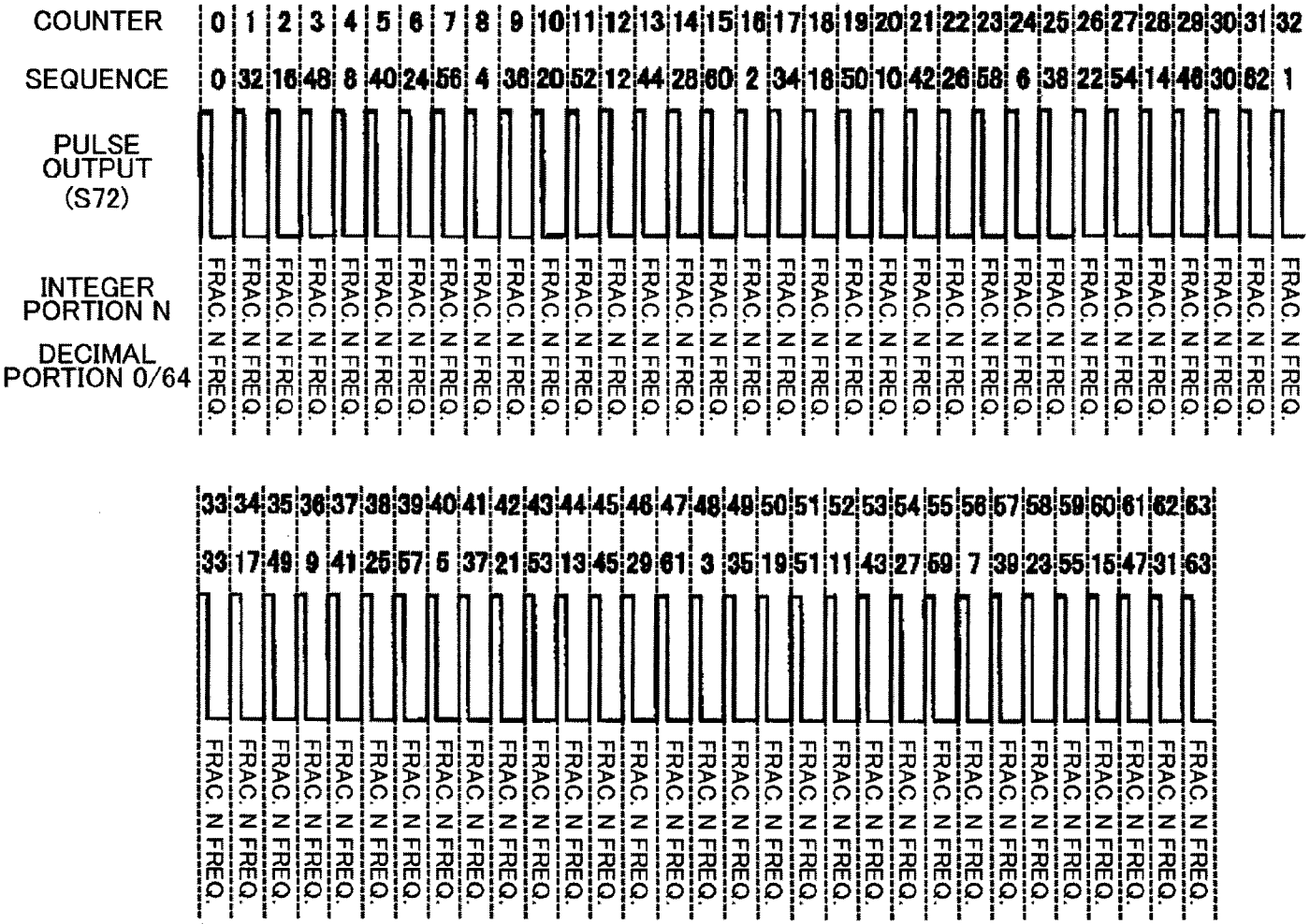
FIGS. 9A, 9B, 9C, 9D, 9E, 9F, and FIG. 9G are schematic timing diagrams illustrating a state of a driving pulse in frequency division operation of the controller.
Figure 9B:
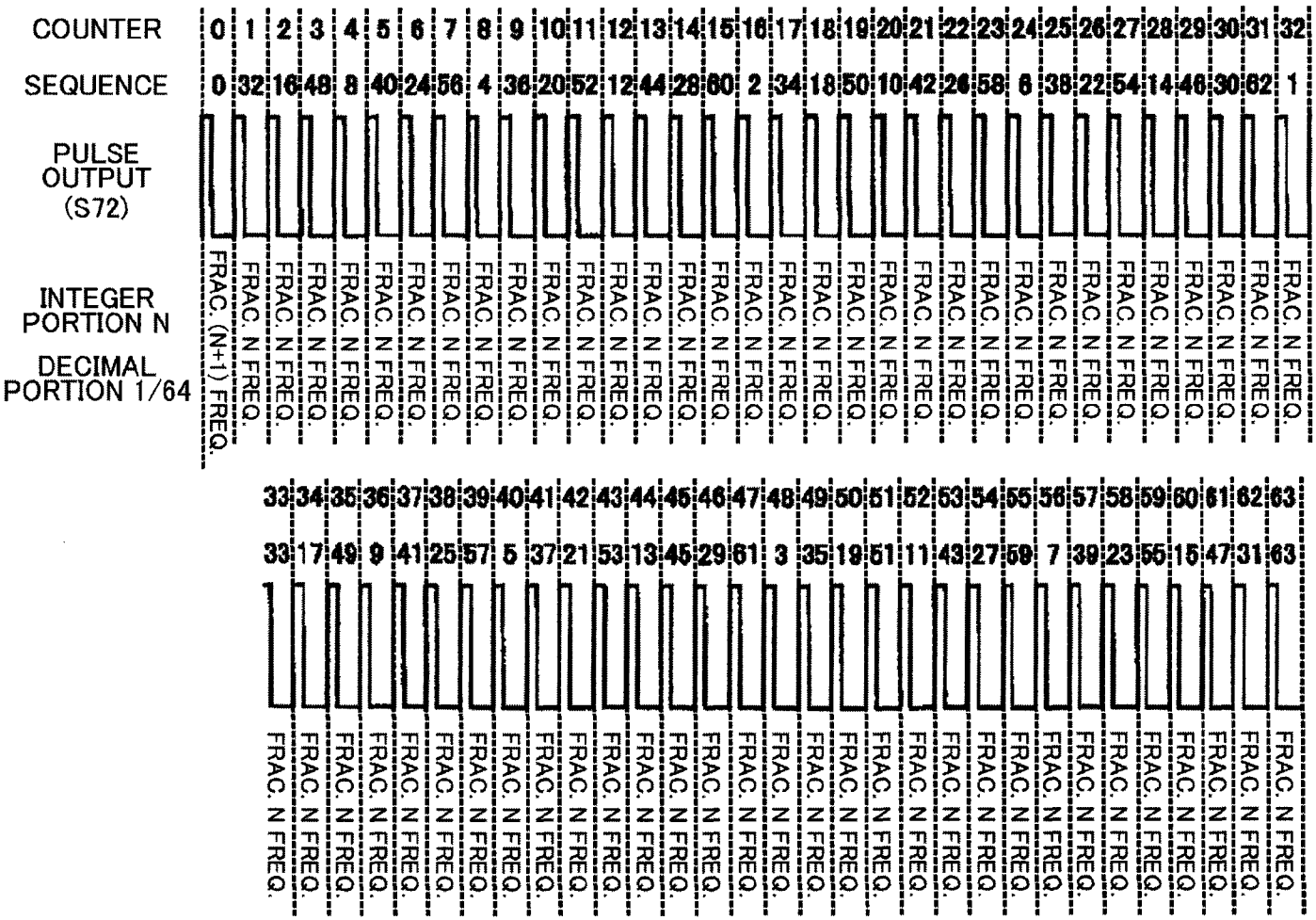
Figure 9C:
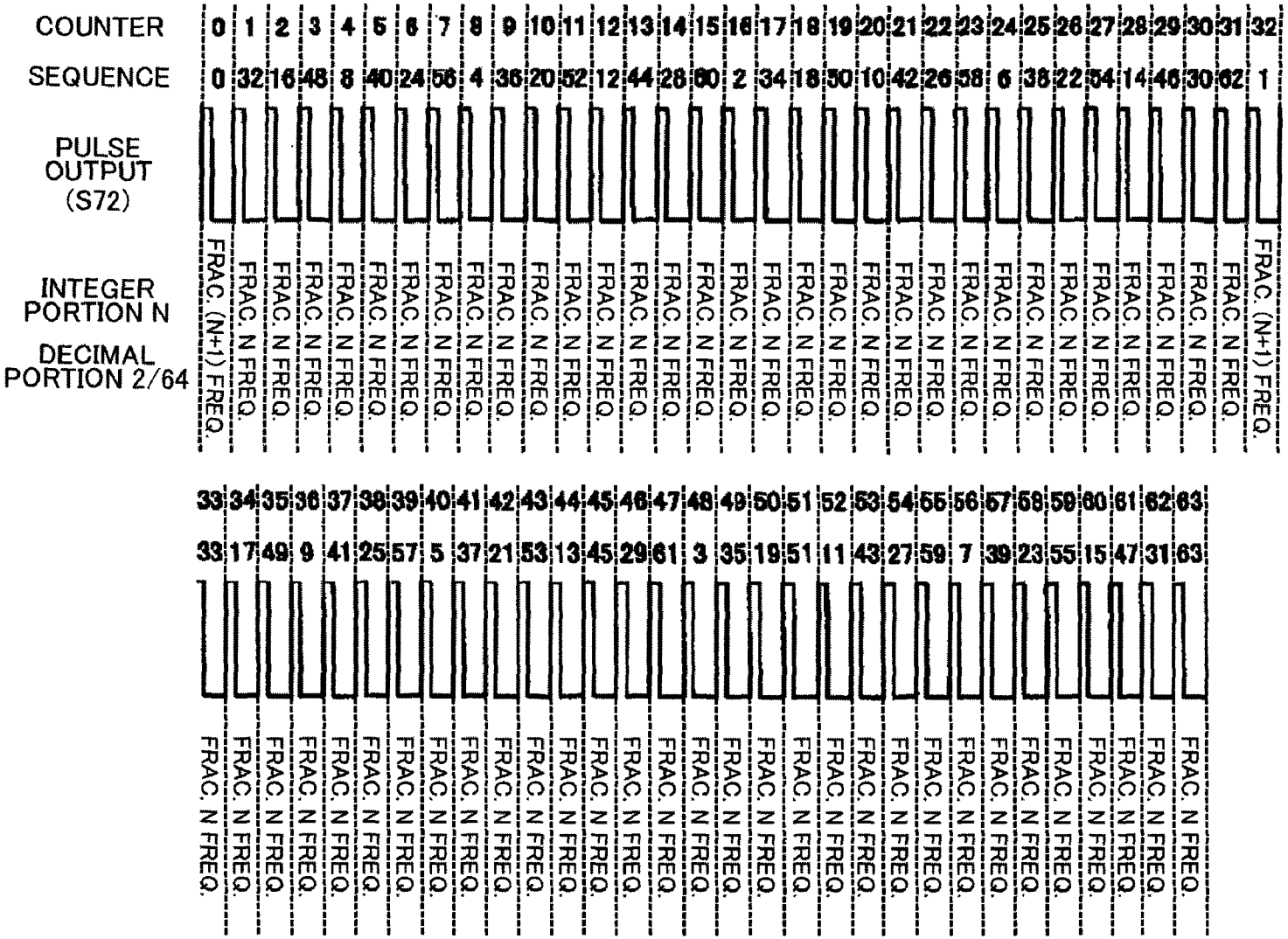
Figure 9D:
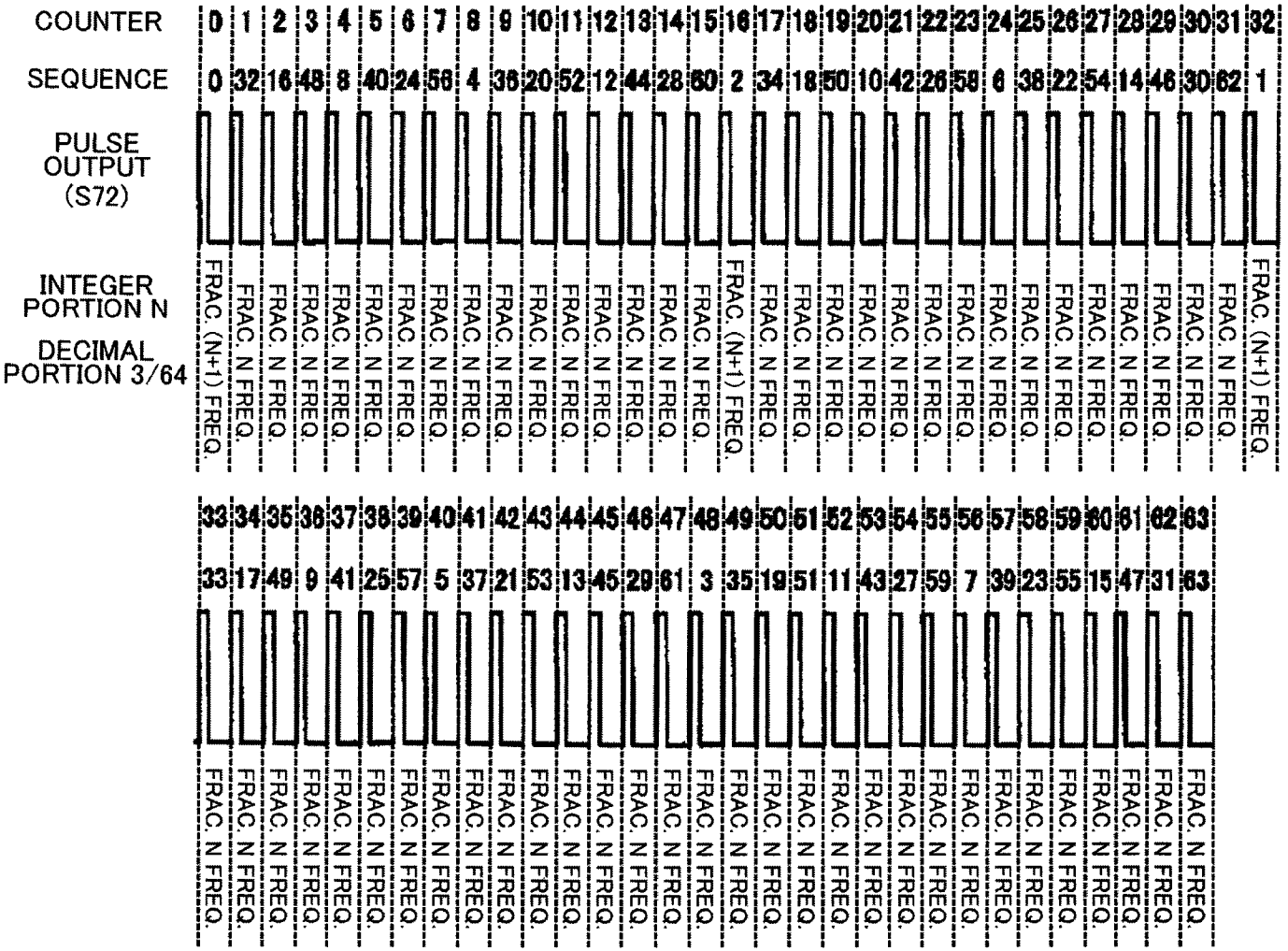
Figure 9E:
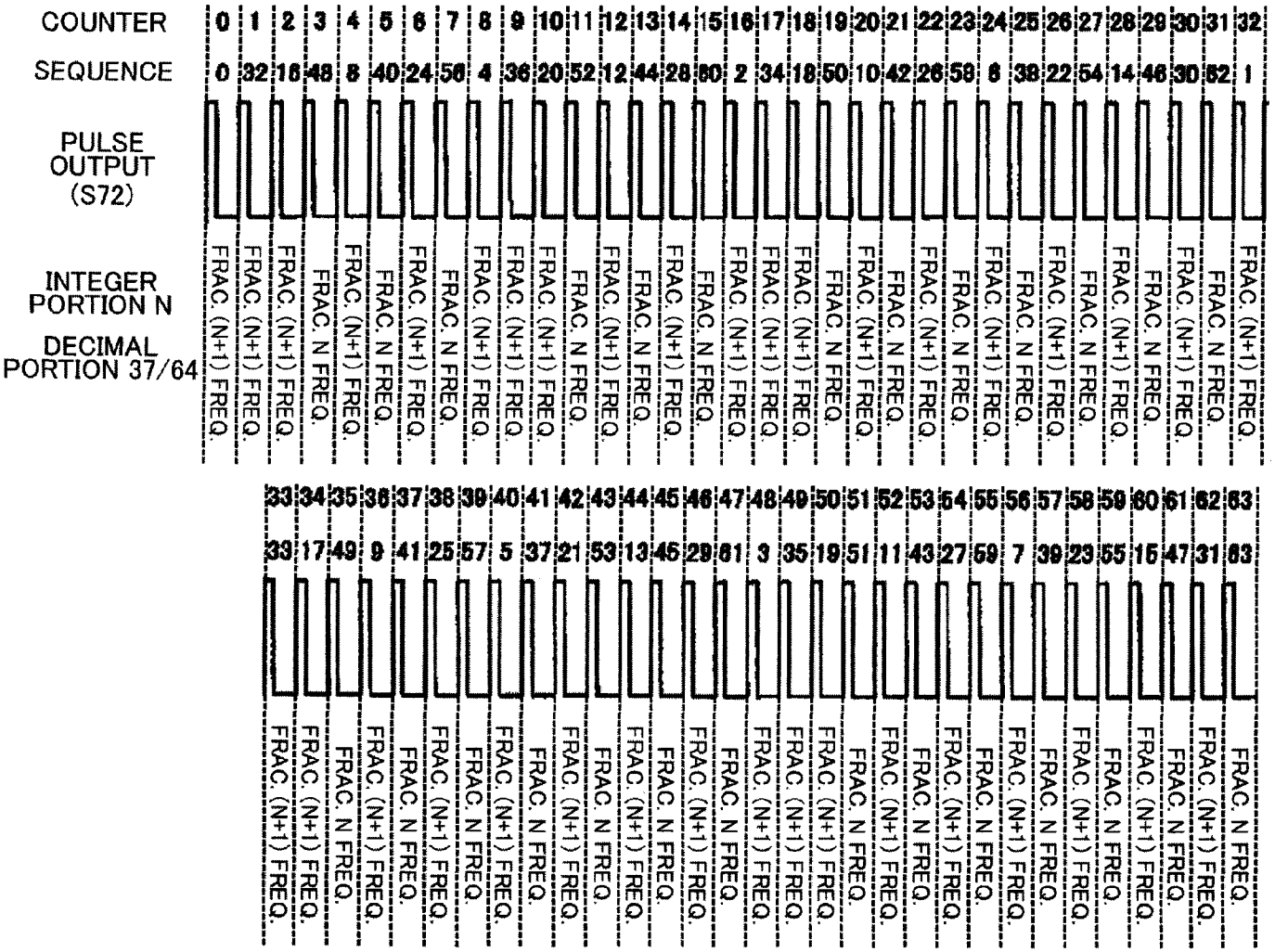
Figure 9F:
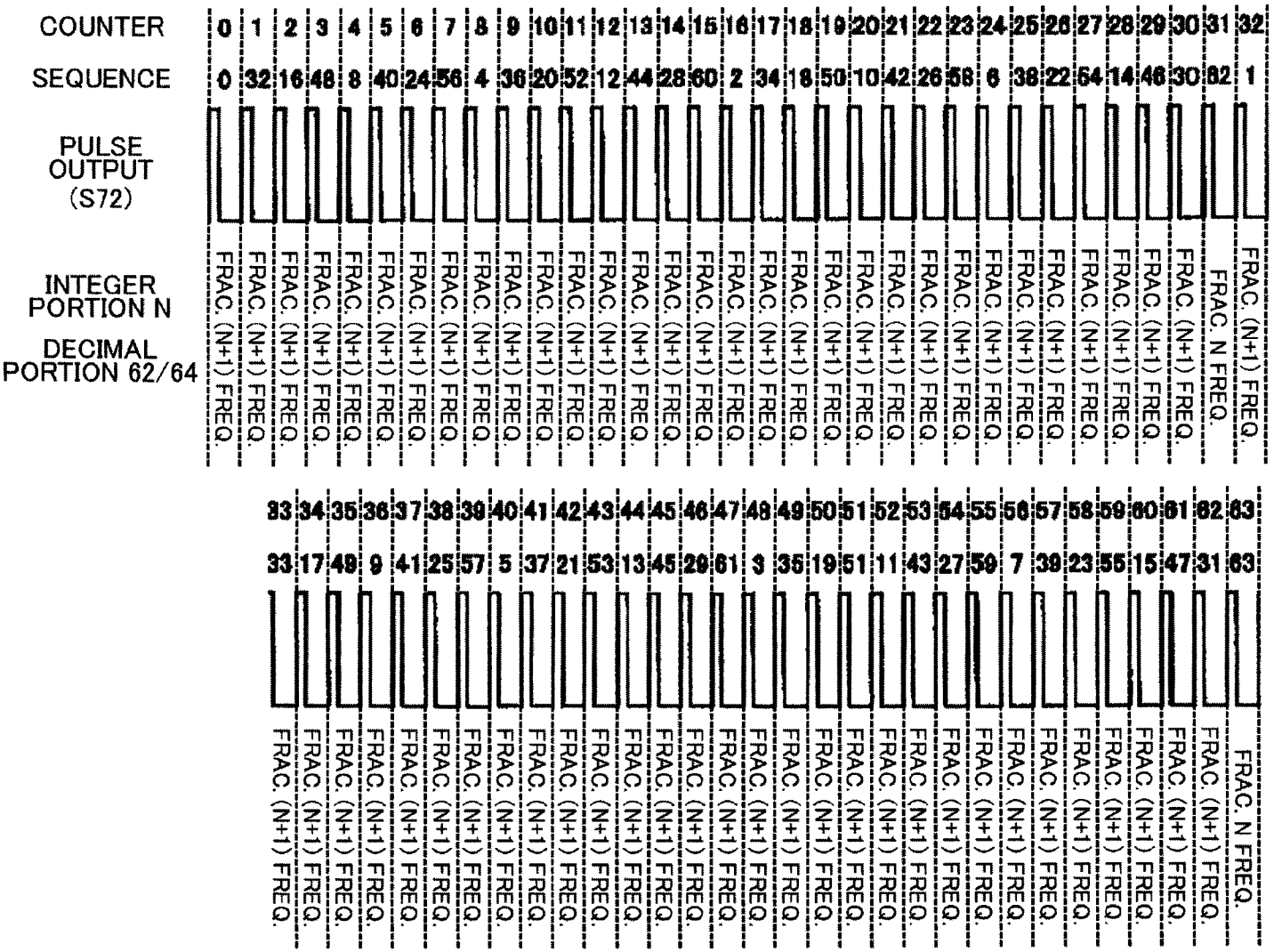
Figure 9G:
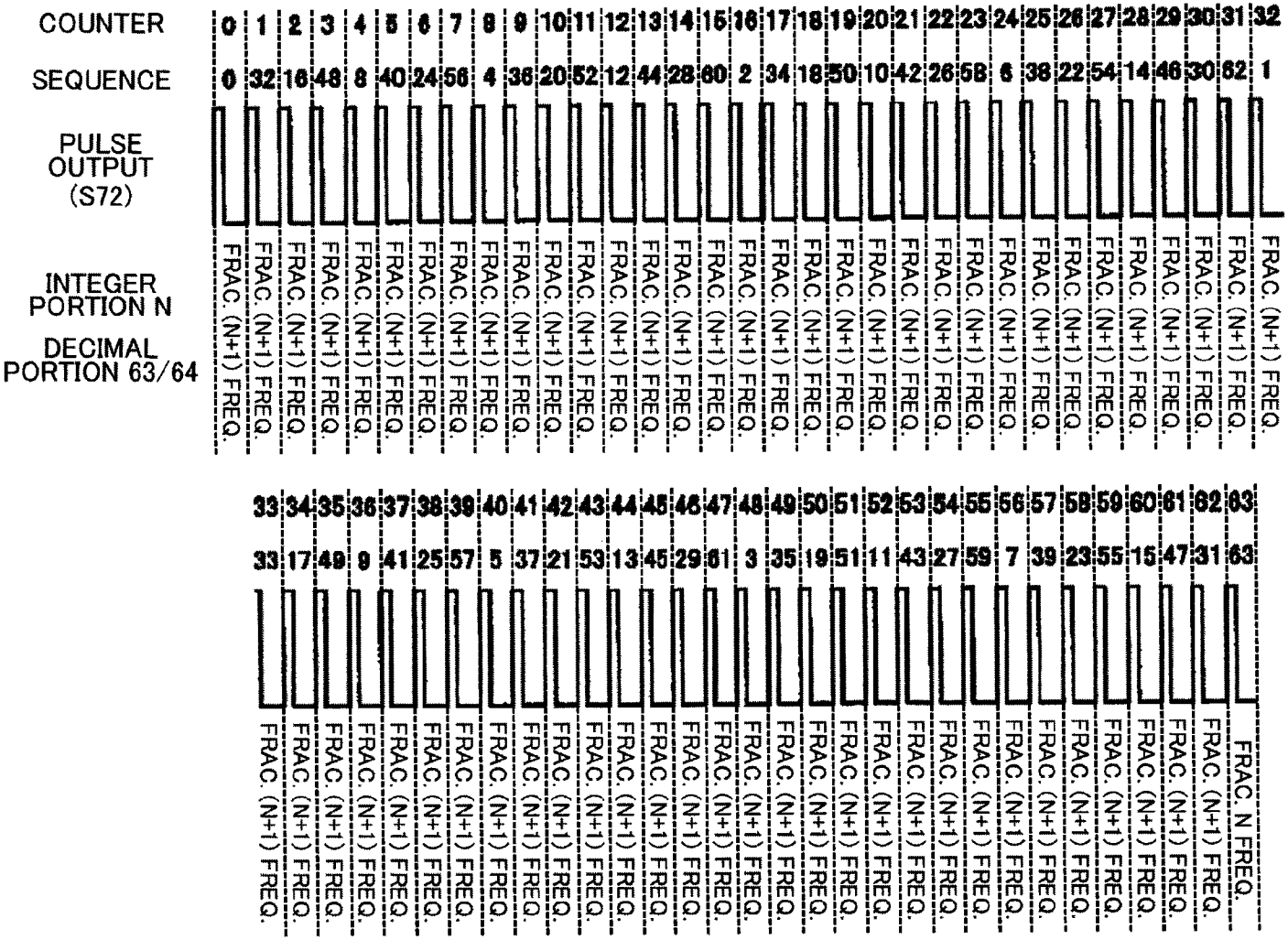

Referring to FIG. 8, the operation of the power source device 70 of FIG. 2 is illustrated in a schematic waveform.

The printer engine controller 53 sets the reset signal "RESET" output from the output port OUT3 to be the "L" level, thereby resetting various settings for the output port OUT1 therein. Herein, the reset signal represents an "L" true signal. The reset operation allows, for example, the value of the frequency division ratio of the output port OUT1 to be initialized.

The DAC 53*a* of the printer engine controller 53 outputs the target voltage V53*a* serving as an instruction voltage with respect to a target voltage value of the high voltage output. For example, where the high voltage output is 5 kV, the DAC 53*a* outputs the target voltage V53*a* of 2.5 V. Herein, the DAC 53*a* has the resolving power of 10-bit and the range of 3.3V, so that a prescribed register inside the DAC 53*a* is set to be 307H. After the target voltage V53*a* is output from the DAC 53*a*, the reset signal "RESET" is switched to "H" level. In a case where the reset is released, the controller 72 allows the CLK input from the clock input port CLK_IN at the initial value to be divided by the frequency division ratio of the initial value using the ON-duty 30 percent. However, while the ON/OFF signal output from the output port OUT2 of the printer engine controller 53 is being the "L" level, the driving pulse S72 of which the frequency is divided is not output from the output port OUT 1, thereby holing the output thereof to be the "L" level.

The controller 72 has the clock input port CLK_IN connected with the oscillator 71 through the resistance 71*b*. The oscillator 71 includes the power source terminal VDD and the output enable terminal OE applied with the DC 3.3 V from the power source 71*a*, and outputs the CLK running at the oscillation frequency of 33.33 MHz and a cycle of 30 nsec from the CLK terminal thereof immediately after the power source 71*a* is activated.

While the output port OUT 1 is being held in the "H" level, the NMOS 74*a* of the piezoelectric transformer driving circuit 74 remains OFF. Accordingly, the primary input terminal 75*a* of the piezoelectric transformer 75 is applied with the DC 24 V supplied from the DC power source 73. In such a state, the DC 24 V has the current value of approximately zero (0), and the piezoelectric transformer 75 does not vibrate. Accordingly, the output terminal 75*b* provided on the secondary side of the piezoelectric transformer 75 has the voltage of zero (0) V, and the operational amplifier 77*d* of the output voltage converter 77 has the output voltage of the "L" level.

In the above state, the output voltage comparator 78 has the comparator 78*a* having the positive input terminal provided with the input of 2.5 V and the negative input terminal provided with an input of the "L" level of the operational amplifier 77*d*. Therefore, the comparator 78*a* has the output terminal having the DC 3.3 V pulled up by the power source 78*b*, and the controller 72 has the input port IN1 provided with an input of the "H" level.

Subsequently, the printer engine controller 53 allows the ON/OFF signal output from the output port OUT2 to be the "H" level at the prescribed timing, thereby allowing a high voltage output to be in an ON state. In a case where the input port IN2 receiving an input of the ON/OFF signal becomes the "H" level, the controller 72 allows the driving pulse S72 to be output from the output port OUT1. Herein, the driving pulse S72 has the frequency divided by the initial value. According to the first embodiment, for example, the initial value has the fractional-290 frequency, one cycle of 8.7 μsec, and ON-duty of 29 percent. The NMOS 74*a* of the piezoelectric transformer driving circuit 74 is switched by the driving pulse S72 output from the output port OUT1, so that the primary input terminal 75*a* of the piezoelectric transformer 75 is applied with a half-wave sine curve having the voltage of several tens V as illustrated in FIG. 8 by the inductor 74*c* and the capacitor 74*d* and the piezoelectric transformer 75.

Accordingly, the piezoelectric transformer 75 vibrates, so that an alternative current high voltage boosted is generated from the secondary side output terminal 75*b*. Herein, the drive frequency of fractional-290 frequency at 114.94 kHz provides the output having the voltage of several hundreds volts. The secondary side output terminal 75*b* has the AC high voltage to be rectified into the DC voltage by the rectifier 76 and divided by the output voltage converter 77 including the resistance 77*a* having 200 MΩ and the resistance 77*b* having the 100 kΩ. The voltage input to the negative input terminal of the comparator 78*a* in the output voltage comparator 78 through the operational amplifier 77*d* is lower than the target voltage V53*a* of 2.5 V output from the DAC 53*a*. Therefore, the comparison result S78 of the comparator 78*a* becomes the "H" level pulled up by the power source 78*b* having the DC 3.3 V.

Figure 10:
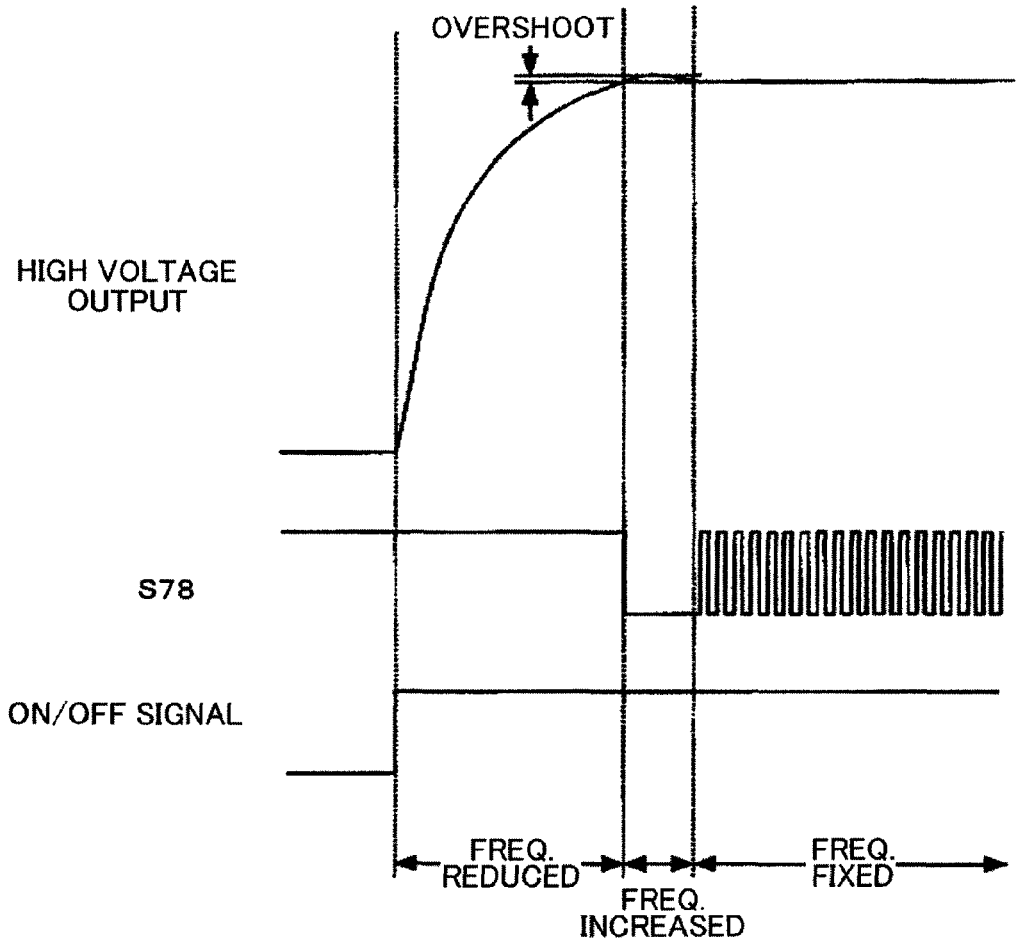
FIG. 10 is a schematic operation waveform diagram illustrating a relationship between a high voltage output and frequency control in the power source device of FIG. 2.

Referring to FIG. 9A through FIG. 9G, a state of the driving pulse S72 in the frequency division operation by the controller 72 is illustrated in a timing diagram. Referring to FIG. 10, a relationship between the overshoot of the high voltage output and the comparator output (e.g., the comparison result S78) in the power source device 70 of FIG. 2 is illustrated in a schematic waveform diagram.

As illustrated in FIG. 9A through FIG. 9D, the operation of the controller 72 allows the driving pulse S72 of fractional-N frequency to be repeatedly output from the output port OUT1 for sixty four times (i.e., 64 driving pulses S72 or 64 units of the driving pulses S72). At this time, the controller 72 has the input port IN1 having the input of the "H" level, thereby allowing the 64 units of driving pulses S72 to increase the frequency division ratio one by one with respect to each pulse output from the timer 86. The timer (divider) 86 has the cycle of 1280H (that is, 142.08 μsec cycle of 4,736 clock cycle in a decimal number system). A timing to change the frequency division ratio may not necessarily be synchronized with delimitation of the 64 units of driving pulses S72, and may be optionally set. As illustrated in FIG. 9A through FIG. 9G, for example, the driving pulse or pulses S72 of the fractional-N frequency and the driving pulse or pulses S72 of the fractional-N+1 frequency are output corresponding to the decimal portion values from 0/64 to 63/64 of the frequency division ratio setting value with respect to the 64 units of driving pulses S72. While the comparison result S78 of the comparator 78*a* is being the "H" level, decimal portions of the frequency division ratio are sequentially increased one by one (i.e., by 1/64), for example, 4/64, 5/64, . . . and 11/64 in respective timing diagrams (not shown), thereby increasing the driving pulse S72 of the fractional-N+1 frequency to be 1/64, 2/64, and so forth. Each of the 64 units of driving pulses S72 increases the frequency division ratio one by one, so that an average frequency of the driving pulses S72 to be output from the output port OUT1 decreases. In a case where the 64-unit cycle of driving pulses S72 (a combination of an integer portion and the decimal portion) are output, the set frequency and the average frequency value become substantially equal. However, for example, in a case where the frequency division ratio having the decimal portion of 37/64 as illustrated in FIG. 9-5 has the average frequency of 64 pulses, the frequency division ratio setting value is calculated as follows.

$$\{27\times N+37\times(N+1)\}/64=N+37/64=N+0.578125$$

In a case where the average frequency is reduced by half to 32 pulses, the frequency division ratio setting value is calculated as follows.

$$\{13\times N+19\times(N+1)\}/32=N+19/32=N+0.59375$$

In a case where the average frequency is further reduced by half to 16 pulses, the frequency division ratio setting value is calculated as follows.

$$\{6\times N+10\times(N+1)\}/16=N+10/16=N+0.625$$

Herein, the average frequency becomes substantially the same. In a case where the average frequency is with 8 pulses, the frequency division ratio setting value is calculated as follows.

$$\{3\times N+5\times(N+1)\}/8=N+5/8=N+0.625$$

Accordingly, the average frequency is provided in any setting value with the 64 pulses. However, the average frequency can be approximated in a shorter time period. In a case where the piezoelectric transformer 75 is driven by mixture of the driving voltages having different cycles, the piezoelectric transformer 75 vibrates at the average frequency of the driving voltages supplied. However, in a case where the piezoelectric transformer 75 is driven in such a manner that the average frequency becomes close to the average value in a short time period, the output voltage having less ripples can be obtained.

The lower the driving frequency of the piezoelectric transformer 75, the higher the DC high voltage output from the rectifier 76. Consequently, the output voltage of the operational amplifier 77*d* increases. The AC high voltage output from the piezoelectric transformer 75 has the output voltage to be increased according to a time slightly delayed from the frequency fluctuation of the driving pulse S72 output from the output port OUT1, so that the operational amplifier 77*d* has the output voltage having the voltage slightly above 2.5 V. Consequently, the comparison result S78 of the comparator 78*a* becomes the "H" level. In a case where the input of the input port IN1 is held in the "L" level, the controller 72 allows the decimal portion of the frequency division ratio to be reduced by 1/64. Such reduction operation allows the setting value to be changed in a direction increasing the average frequency corresponding to the value of the decimal portion as illustrated in FIG. 9A to FIG. 9G. Accordingly, an output effective value of the operational amplifier 77*d* becomes 2.5 V through the overshoot described above, and the comparison result S78 of the comparator 78*a* becomes the rectangular wave as illustrated in FIG. 8.

The output voltage of the output voltage converter 77 (that is, the output voltage of the operational amplifier 77*d*) is illustrated in a dashed line in FIG. 8. Such an output voltage is provided by remaining the AC component of the piezoelectric transformer 75 as the ripple, and does not become a complete flat DC voltage. The target voltage V53*a* output from the DAC 53*a*, on the other hand, becomes the DC voltage as illustrated in a solid line in FIG. 8, and the comparison result S78 output from the comparator 78*a* (that is, the output voltage of the output voltage comparator 78) becomes the rectangular wave. The controller 72 counts the duty of the rectangular wave with respect to a pulse cycle of the output port OUT1. Where the duty is greater than 25 percent and smaller than 50 percent (25%<Duty<50%), the controller 72 allows the frequency division ratio to be fixed as the target voltage V53*a* is reached. Where the duty is greater than 50 percent (50%<Duty), the controller 72 controls the frequency division ratio in a direction reducing the average frequency such that the high voltage output increases. Where the duty is smaller than 25 percent (Duty<25%), the controller 72 controls the frequency division ratio in a direction increasing the average frequency such that the high voltage output decreases. As illustrated in FIG. 10, the overshoot is generated by sequentially changing the driving frequency. The overshoot becomes a stable constant voltage in a case where the target voltage V53*a* is reached.

In a case where the power source 70 has the high voltage output shifted by the fluctuation of the load ZL, the comparison result S78 output from the comparator 78*a* become the "H" or "L" level, so that the frequency is controlled to fluctuate in such a manner as to follow the target voltage V53*a*.

A description is now given of the operation of the controller 72 of FIG. 6 and FIG. 7 with reference to FIG. 9A through FIG. 9G. As described above, the controller 72 is disposed inside the power source device 70.

In a case where the reset signal "RESET" is input to the input port IN3, each counter and the like are initialized. The frequency division counter 88 receives the value of the initial value register 95 input thereto, thereby setting the value thereof to be the value 290. The subtractor 89 allows the value 290 of the frequency division counter 88 and the value 289 of the subtractor 89 to be input to the frequency division selector 90. In a case of the initial state, the value 289 of the subtractor 89 is input to the frequency divider 91. The frequency divider 91 outputs the pulse with respect to each count of clocks from zero (0) to 289. Therefore, the frequency divider 91 outputs the pulse of the fractional-290 frequency to the output selector 93. In a case where the ON/OFF signal input to the input port IN2 is the "H" level (i.e., ON), the output selector 93 outputs the driving pulse S72. In a case where the ON/OFF input to the input port IN2 is other than the "H" level, the output selector 93 allows the output to be held in the "L" level.

The 6-bit counter 87, serving as the counter, indicates the frequency division ratio below the decimal point. The frequency division ratio starts at fractional-290 frequency, and changes the frequency division ratio of the 64 pulses one by one, for example, 1/64, 2/64, . . . 63/64 until the frequency division ratio becomes fractional-291 frequency. The initial value "000000b" represents the existence of the 64 pulses each of which has the fractional-290 frequency. The value "111111b" represents the existence of the 63 pulses each of which has the fractional-291 frequency and 1 pulse having the fractional-290 frequency. The frequency division ratio corresponding to each setting value is illustrated in FIG. 9A through FIG. 9G.

For example, the fractional-N frequency and the fractional-N+1 frequency of FIG. 9A through FIG. 9G. represent the fractional-290 frequency and fractional-291 frequency, respectively. In a case where the value of the 6-bit counter 87 is counted up from "111111b" to "000000b", the over flow "over" is output as the carry of the highest-order bit, and the frequency division counter 88 is counted up. In a case where the value of the 6-bit counter 87 is counted down from "000000b" to "111111b", the under flow "under" is output, and the frequency division counter 88 is counted down. Herein, in a case where the frequency division counter 88 tends to count up, the register value of the upper limit register 96 and the value of the frequency division counter 88 are compared. Where the values of the upper limit register 96 and the frequency division counter 88 are equal, the counting up is not performed. In a case where the frequency division counter 88 tends to count down, on the other hand, the counter initial value and the value of the frequency division counter 88 are compared. Where the counter initial value and the value of the frequency division counter 88 are equal, the counting down is not performed.

The upper limit value is set to be the value 301 according to the first embodiment. Consequently, a combination of one (1) pulse of fractional-301 frequency and the 63 pulses of fractional-302 frequency is provided, thereby providing the minimum average driving frequency of 110.38 kHz. In a case where the upper limit value and the value of the frequency division counter 88 are equal, the value of the 6-bit counter 87 is changed from "111111b" to "000000b" while the value of the frequency division counter 88 is not changed, so that the number of the fractional-301 frequency pulses becomes 64, and the average driving frequency is increased from 110.38 kHz to 110.74 kHz. In this case, the fluctuation of the average driving frequency is that of 0.36 kHz, and therefore, the device of the invention raises substantially no problem because it is the case only where the frequency changes exceeding the controllable range.

According to the first embodiment, the 6-bit counter 87 has the value changed from "111111b" to "000000b", and the frequency division counter 88 has the value fixed. However, a circuit capable of halting the count-up of the 6-bit counter 87 may be employed.

According to the first embodiment, the transfer roller 5 serving as the load ZL is applied with the transfer bias having a voltage range, for example, from 1 kV to 5 kV, and the high voltage output is below 1 kV in the start frequency division ratio of fractional-290 frequency at 114.9 kHz, so that the value of the 6-bit counter 87 is changed from the "000000b" to "111111b" with the lower limit value, and the value of the frequency division counter 88 remains unchanged. The frequency can fluctuate from 114.94 kHz with 32 units of fractional-290 frequency to 114.55 kHz with 1 unit of fractional-290 frequency and 63 units of fractional-291 frequency without any inconvenience. A circuit capable of halting the counting up of the 6-bit counter 87 may be employed.

The frequency divider 91 alternatively outputs the pulses of the frequency division ratio for the set value to the frequency division counter 88 and for the value subtracting 1 (that is, +(−1)) from the set value to the frequency division counter 88. An alternate output rate can be switched based on the comparison between the output value of the 6-bit sequence generator 92 and the output value of the 6-bit counter 87 by the comparator 83-3. Particularly, the 6-bit sequence generator 92 outputs the sequence of bit 5 to bit 0 by arranging the value counted with respect to each of the 64 pulses output from the frequency divider 91 through the output selector 93 as illustrated in FIG. 7. Such switching operation allows the driving pulse S72 to be output with the frequency division ratio as illustrated in FIG. 9A through FIG. 9G.

At the time of the frequency division, arithmetic operation (stated below) determines the count value approximately 30 percent of the value of the frequency division counter 88, and the driving pulse S72 having the ON duty of 30 percent is output.

Approximately 30% value=(frequency division counter value/4)+(frequency division counter value/32)+(frequency division counter value/64)

The value of the 6-bit sequence generator 92 is input to the third comparator 83-3, and the third comparator 83-3 compares the value of the 6-bit sequence generator 92 and the value of the 6-bit counter 87. Where the value of the 6-bit counter 87 is greater than that of the 6-bit sequence generator 92, the third comparator 83-3 outputs the selection signal "select" having the "L" level with respect to the frequency division selector 90. Where the value of the 6-bit counter 87 is not greater than that of the 6-bit sequence generator 92, on the other hand, the third comparator 83-3 outputs the selection signal "select" having the "H" level with respect to the frequency division selector 90. The frequency division selector 90 selects the value of the frequency division counter 88 and outputs to the frequency divider 91 in a case where the selection signal "select" output from the comparator 83-3 is the "L" level. The frequency division selector 90, on the other hand, selects the value of the subtractor 89 and outputs to the frequency divider 91 in a case where the selection signal "select" output from the comparator 83-3 is the "H" level.

The leading edge detector 94 outputs the pulse of one clock synchronized with the CLK upon detecting the leading edge of the driving pulse S72 output from the frequency divider 91 through the output selector 93. In other words, the leading edge detector 94 outputs the pulse of one cycle of the ON duty delayed by one cycle relative to the leading edge at the same frequency synchronized with the frequency divider 91. The pulse becomes the reset signal "reset" used for the count operation by the up-counter 81 with respect to each pulse output from the frequency divider 91, so that the up-counter 81 is reset by the reset signal "reset." When the up-counter 81 is cleared to zero (0), the value immediately before clearing the up-counter 81 to zero becomes the set signal "set" to be held in the D-latch 82.

The timer 86 counts the pulse of the CLK and outputs the pulse of one cycle of the ON duty at the prescribed timing (e.g., 142.08 μsec). The prescribed timing of 142.08 μsec represents a control cycle to fluctuate the frequency. However, the timing is not limited thereto. The timer 86 outputs the pulse to be input to the AND circuit 85, and the pulse becomes the signal used for counting up and down of the 6-bit counter 87 to shift the average frequency according to the signal state of the comparison result S78 output from the comparator 78*a* of FIG. 2.

The average frequency is set in such a manner as to be equal to the value of the target voltage V53*a* with respect to every 64 pulses. However, since the frequency is approximated even below the 64 pulses, the cycle may be shorter than the cycle of the 64 pulses. The cycle may be longer than the cycle of, for example, the 64 pulses, not equal to the integral multiple of the 64 pulses.

In a case where the piezoelectric transformer 75 has, for example, the output voltage shift of 500 V per driving frequency fluctuation of 0.1 kHz as illustrated in FIG. 2, the average frequency needs to be set in such a manner as to finely shift around the resonant frequency. The shorter the time for restoring the average frequency, the smaller the ripple of the DC high voltage output.

The up-counter 81, the D-latch 82, the comparators 83-1, 83-2, the dividers 84-1, 84-2, and the AND circuit 85 allow the 6-bit counter 87 to output a count-up signal "up" and a count-down signal "down" to control the average frequency according to three states of the comparison result S78 output from the comparator 78*a* as illustrated in FIG. 2 at the pulse cycle output from the frequency divider 91. Herein, the three states represent the comparison result S78 having the duty between 25% and 50%, greater than or equal to 50%, and smaller than or equal to 25%. The results of the three states are output to the AND circuit 85 for 32 times, one of which is synchronized with the clock of the leading edge detector 94 and is output by the AND circuit 85.

According to the first embodiment, the result obtained from one pulse in a certain period within the cycle of 142.08 μsec is used. However, a circuit capable of selecting the three signal states such as the count-up, count-down, and hold abased on an average result obtained by a plurality of pulses in the same period may be applied. According to the first embodiment, the three signal states such as the count-up, count-down, and hold are used. However, two signal states such as count-up and count down may be applied. According to the first embodiment, the decimal portion has the resolving power of 6-bit for the sake of simplicity. However, the decimal portion is not limited thereto. For example, the decimal portion may have the resolving power of 10-bit with a 1024 frequency cycle. In a case where the resolving power is set to be 10-bit, the output voltage resolving power becomes fine, so that the decimal portion setting cycle of 142.08 μsec has a shorter cycle.

The up-counter 81, serving as the 10-bit counter, counts the pulse of CLK. The up-counter 81 counts up in a case where the comparison result S78 output from the comparator 78*a* is the "H" level. In a case where the comparison result S78 output from the comparator 78*a* is the "L" level, on the other hand, the up-counter 81 does not count, that is, holds the value of "L" level. The up-counter 81 is reset by the pulse output from the leading edge detector 94 (i.e., the reset signal "reset").

The D-latch 82 latches the value of the up-counter 81 using the leading edge of the pulse output from the leading edge detector 94. In a case where the output signal of the frequency divider 91 is selected by the output selector 93, the latching operation allows the D-latch 82 to holds a cycle number therein while the comparison result S78 in one pulse cycle of the frequency divider 91 is being the "H" level.

The first divider 84-1 holds the value having ½ (hereafter referred to as a ½ value) of the frequency division counter 88 by adding zero (0) to the lowest-order bit with respect to a 9-bit value provided by shifting the 10-bit value of the frequency division counter 88 to the right by 1 bit. At the time of the ½ division, the first divider 84-1 rounds down the lowest-order bit of the 10-bit value of the frequency division counter 88. The second divider 84-2 holds the ¼ value of the frequency division counter 88 by adding zero (0) to the lowest-order 2 bits with respect to an 8-bit value provided by shifting the 10-bit value of the frequency division counter 88 to the right by 2-bit. At the time of the ¼ division, the second divider 84-2 rounds down the lowest-order 2 bits of the 10-bit value of the frequency division counter 88.

The first comparator 83-1 compares the value of the D-latch 82 and the value of the first divider 84-1. Where the value of the D-latch 82 is smaller than that of the first divider 84-1, the first comparator 83-1 outputs the "L" level to the AND circuit 85. Where the value of the D-latch 82 is not smaller than that of the first divider 84-1, the first comparator 83-1 outputs the "H" level to the AND circuit 85. In other words, where the first divider 84-1 has the value greater than or equal to 50 percent of the pulse cycle output from the frequency divider 91, and where the comparison result S78 is the "H" level, the first comparator 83-1 outputs the "H" level to the AND circuit 85. When the AND circuit 85 receives the input of the leading edge pulse with the signal of "H" level from the leading edge detector 94, the count-down signal "down" is output to count down the 6-bit counter 87. Since the comparison result S78 becomes the "H" level while the high voltage output is being lower than the target voltage V53*a*, the count value of the 6-bit counter 87 is subtracted and controlled in a direction reducing the average frequency of the pulse output from the frequency divider 91 until the target voltage V53*a* is reached. In a case where the period for the "H" level of the comparison result S78 becomes shorter than 50 percent of an output pulse width of the frequency divider 91, the count-down signal "down" to be output to the 6-bit counter 87 becomes the "L" level, so that the counting down is not performed.

The second comparator 83-2 compares the value of the D-latch 82 and the value of the second divider 84-2. Where the value of the D-latch 82 is greater than that of the second divider 84-2, the second comparator 83-2 outputs the "L" level to the AND circuit 85. Where the value of the D-latch 82 is not greater than that of the second divider 84-2, the second comparator 83-2 outputs the "H" level to the AND circuit 85. In other words, where the second divider 84-2 has the value smaller than or equal to 25 percent of the pulse cycle output from the frequency divider 91, and where the comparison result S78 is the "L" level, the second comparator 83-2 outputs the "H" level to the AND circuit 85. When the AND circuit 85 receives the input of the leading edge pulse with the signal of "H" level from the leading edge detector 94, the count-up signal "up" is output to count up the 6-bit counter 87. Since the comparison result S78 becomes the "L" level while the high voltage output is being higher than the target voltage V53*a*, the count value of the 6-bit counter 87 is added and controlled in a direction increasing the average frequency of the pulse output from the frequency divider 91 until the target voltage V53*a* is reached. In a case where the period for the "H" level of the comparison result S78 becomes longer than 25 percent of the output pulse width of the frequency divider 91, the count-up signal "up" to be output to the 6-bit counter 87 becomes the "L" level, so that the counting down is not performed.

Therefore, the output signals from the first and second comparators 83-1, 83-2 allow the count value of the 6-bit counter 87 to move up and down. In a case where the comparison result S78 has the "H" level duty of 25 percent to 50 percent with respect to the pulse of the frequency divider 91, the value of the 6-bit counter 87 is held, and the average frequency is fixed.

The comparison result S78 has the waveform as illustrated in FIG. 8 when the comparison result S78 reaches the target voltage V53*a*. The comparator 78*a* compares the target voltage V53*a* (illustrated in a solid line in FIG. 8) output from the DAC 53*a* serving as the target voltage setting unit and the voltage (illustrated in a dashed line in FIG. 8) output from the output voltage converter 77, and outputs the comparison results S78 having the rectangular wave. The average frequency shifts to control the output voltage until the duty becomes between 25 percent and 50 percent.

According to the first embodiment, the comparison result S78 has the rectangular wave having the duty of 25 percent to 50 percent. However, the duty is not limited thereto. The duty is set between 25 percent and 50 percent for the sake of simplicity of the circuit. However, the effective value of the voltage to be output from the output voltage converter 77 is not necessarily equal to the output voltage of the DAC 53*a* as long as the comparison result S78 has the "H" period and "L" period within the pulse cycle to be applied to the NMOS 74*a* serving as the switching element input to the piezoelectric transformer driving circuit 74. The present invention provides the power source device 70 and the image forming apparatus 1 including the power source device 70 capable of stably performing the constant voltage control using the voltage value output from the DAC 53*a* serving as the target voltage setting unit. The relationship between the 10-bit value of the DAC 53*a* and the high voltage output may be provided by a formula calculated based on an experiment or using a table, for example.

The relationship between the output voltage and the frequency control is illustrated in the schematic waveform diagram of FIG. 10. In a case where the controller 72 has the ON/OFF signal having the "H" level to be input to the input port IN2, the output selector 93 outputs the driving pulse S72, thereby providing the high voltage output. While the comparison result S78 is being the "H" level, the average frequency is reduced by approximately 6 Hz by 6 Hz. In a case where the high voltage output reaches the target voltage V53*a*, the comparison result S78 becomes the "L" level, and the average frequency is increased by approximately 6 Hz by 6 Hz. When the target voltage V53*a* is reached, the comparison result S78 becomes the rectangular wave, and the frequency is fixed, thereby outputting the constant voltage. Herein, in a case where the high voltage shifts due to the fluctuation of the load ZL as illustrated in FIG. 2 or due to a state of the piezoelectric transformer 75, the comparison result S78 can be changed, so that the average frequency is immediately controlled in such a manner as to have the prescribed voltage.

The printer engine controller 53 allows the ON/OFF signal to be the "L" level at the prescribed timing, thereby turning OFF the high voltage output. The printer engine controller 53 allows the reset signal "RESET" to be the "L" level to re-initialize the counter and the like disposed inside the controller 72 before allowing a next ON/OFF signal to be the "H" level.

Moreover, the controller 72, serving as a frequency division circuit outputting the pulse S72 having the waveform to the piezoelectric transformer 75, may be provided using a general logic circuit. The output of the output voltage converter 77 may be processed by a micro processing unit (hereafter abbreviated as an MPU), and the frequency division ratio of the frequency division circuit may be changed at a prescribed time interval according to the output voltage.

In addition to the modifications described above, the first embodiment may be modified as follows.

According to the first embodiment, the reset signal "RESET" and the ON/OFF signal are provided. However, the ON/OFF signal having the "L" level may be used as the reset signal "RESET."

The oscillator 71 supplies the CLK running at the frequency of 33.33 MHz in the first embodiment. However, the frequency may not necessarily be 33.33 MHz. Moreover, the frequency division ratio is changed using the 6-bit pulse, that is, 64 pulses. However, a value greater than the 6-bit, for example, 7-bit, 8-bit, 9-bit, and 10-bit, or a value smaller than the 6-bit, for example, 5-bit, and 4-bit, may be applied.

The average frequency fluctuates at the cycle of 142.08 μsec. However, a cycle value may be optionally set according to the bit number of the frequency resolving power, the frequency of the CLK, and a condition of the circuit, for example.

According to the first embodiment described above, the piezoelectric transformer 75 has the resonance frequency of approximately 110 kHz and the driving frequency range between 110 kHz and 130 kHz. However, a piezoelectric transformer having the high driving frequency in a smaller size, or a piezoelectric transformer having a low driving frequency in a larger size may be used.

According to the first embodiment, the controller 72 has the count value, serving as the fixed value, setting the upper limit and lower limit of the driving frequency. However, the counter value may be transmitted from the printer engine controller 53. Each characteristic of the piezoelectric transformer 75 may be measured to store a limit value in a non-volatile memory, for example, so that the limit value may be used instead of the fixed value.

According to the first embodiment, the controller 72 has the piezoelectric transformer driving start frequency as the fixed value. However, the piezoelectric transformer driving start frequency may fluctuate according to the DAC setting value setting the target voltage V53*a*, and transmitted to the controller 72 from the printer engine controller 53.

The power source device 70 includes the controller 72 driving the piezoelectric transformer 75. However, the controller 72 may be disposed inside the LSI and the like of the printer engine controller 53.

According the first embodiment, the power source device 70 having one set of the circuit is described as representative of the power source devices 70. The same circuits may be juxtaposed, so that a plurality of channels can be controlled. A multi-color image forming apparatus usually includes four channels for the transfer high voltage. According to the first embodiment, however, the single from the printer engine controller 53 is switched in a case of ON/OFF of the high voltage output, thereby not necessarily having a special element in the microprocessor or LSI used in the printer engine controller 53. Moreover, in a case where all high voltage outputs including the charging bias and the development bias excluding the transfer bias are provided by circuits using the piezoelectric transformer 75, approximately 10 to 20 channels may be provided if each of the circuits has an appropriate component constant selected.

According to the first embodiment, the DAC 53*a* serving as the target voltage setting unit is used to provide the power source device 70 capable of changing the output for the transfer operation. However, in a case where the power source 70 is used for a high voltage output which does not need the output change, a constant voltage circuit using the zener diode or resistance voltage division may be input to the comparator 78*a* as the target voltage setting unit.

According to the first embodiment, the power source device 70 having the positive bias is described. However, a power source device having a negative bias may be applied if the output voltage converter 77 employs the operational amplifier 77*d* having an inverting amplifier circuit.

According to the first embodiment, the 6-bit sequence generator 92 includes the 6-bit counter 92*a* of which the higher-order bit and the lower-order bit are arranged in a reverse manner. However, in a case where the highest-order bit of the counter 92*a* tends to be arranged in a location of the lowest-order bit of the sequence generator 92*a*, the lower-order bit of the sequence may be replaced, so that the operation similar to the first embodiment can be provided. For example, in a case where the bit 5 (the highest-order bit) of the counter 92*a* tends to be arranged in the bit zero (0) (hereafter simplified as bit 5→bit 0), bit 4→bit 1, bit 3→bit 2, bit 2→bit 3, bit 1→bit 4, and bit 0→bit 5, the lower-order bit of the sequence may be replaced such that bit 5→bit 1, bit 4→bit 0, bit 3→bit 2, bit 2→bit 3, bit 1→bit 4, and bit 0→bit 5.

According to the first embodiment of the present invention, following advantages can be obtained.

The sequence generator 92 reverses the outputs of the counter 92*a*, so that the driving pulses S72 having different cycles are evenly scattered. Therefore, the driving pulse S72 having the average frequency resolving power of several Hz can be obtained, thereby obtaining the stable high voltage output having good controllability even if the CLK running at a low frequency such as several tens MHz is divided.

The comparator 78*a* receives the input of the division output rectified by the rectifier 76 connected to the secondary side output terminal 75*b* in the piezoelectric transformer 75 and the input of the target voltage V53 output from the DAC 53*a* serving as the target voltage setting unit, so that the comparison result S78*a* is controlled such a manner as to have the rectangular wave. Therefore, the constant voltage control can be stably performed from the high voltage output being relatively low to the high output voltage being relatively high close to the resonance frequency of the piezoelectric transformer 75. In addition, a wide output range can be obtained, so that the voltage can be stably output regardless of the environment, thereby capable of obtaining a stable image having substantially no uneven density or a horizontal line, for example.

Each of the driving pulse S72 and the comparison result S78 is provided as the digital signal, so that the circuit having the LSI can be applied. Accordingly, the number of components can be reduced. Moreover, each of the initial value register 95 and the upper limit register 96 serving as the frequency division ratio limiter is disposed such that the driving frequency does not fluctuate to a level below the resonance frequency of the piezoelectric transformer 75, thereby reducing the occurrences of controlling the high voltage output to be relatively low voltage caused by controlling the driving frequency to be lower than the resonance frequency of the piezoelectric transformer 75 by the instantaneous load fluctuation, for example.

According to the first embodiment, not only the driving pulse S72 is generated but also the frequency thereof is controlled without using, for example, a program code of the CPU. Therefore, in a case where multi-channels are applied, the constant voltage control can be stably performed. According to the first embodiment, the sequence generator 92 mixes the driving pulses S72 having the different frequency ratio, so that the average frequency resolving power can be easily increased compared to a multiplication circuit such as a phase-locked loop (PLL).

Second Embodiment

An image forming apparatus and a control circuit according to a second embodiment of the present invention are respectively similar to the image forming apparatus 1 illustrated in FIG. 3 and the control circuit illustrated FIG. 4 according to the first embodiment while a power source device 70A according to the second embodiment differs from the power source device 70 illustrated in FIG. 2 according to the first embodiment. The power source device 70A that differs from the power source device 70 of the first embodiment will be described, and like components including the image forming apparatus and the control circuit will be given the same reference numerals as above and description thereof will be omitted.

Figure 11:
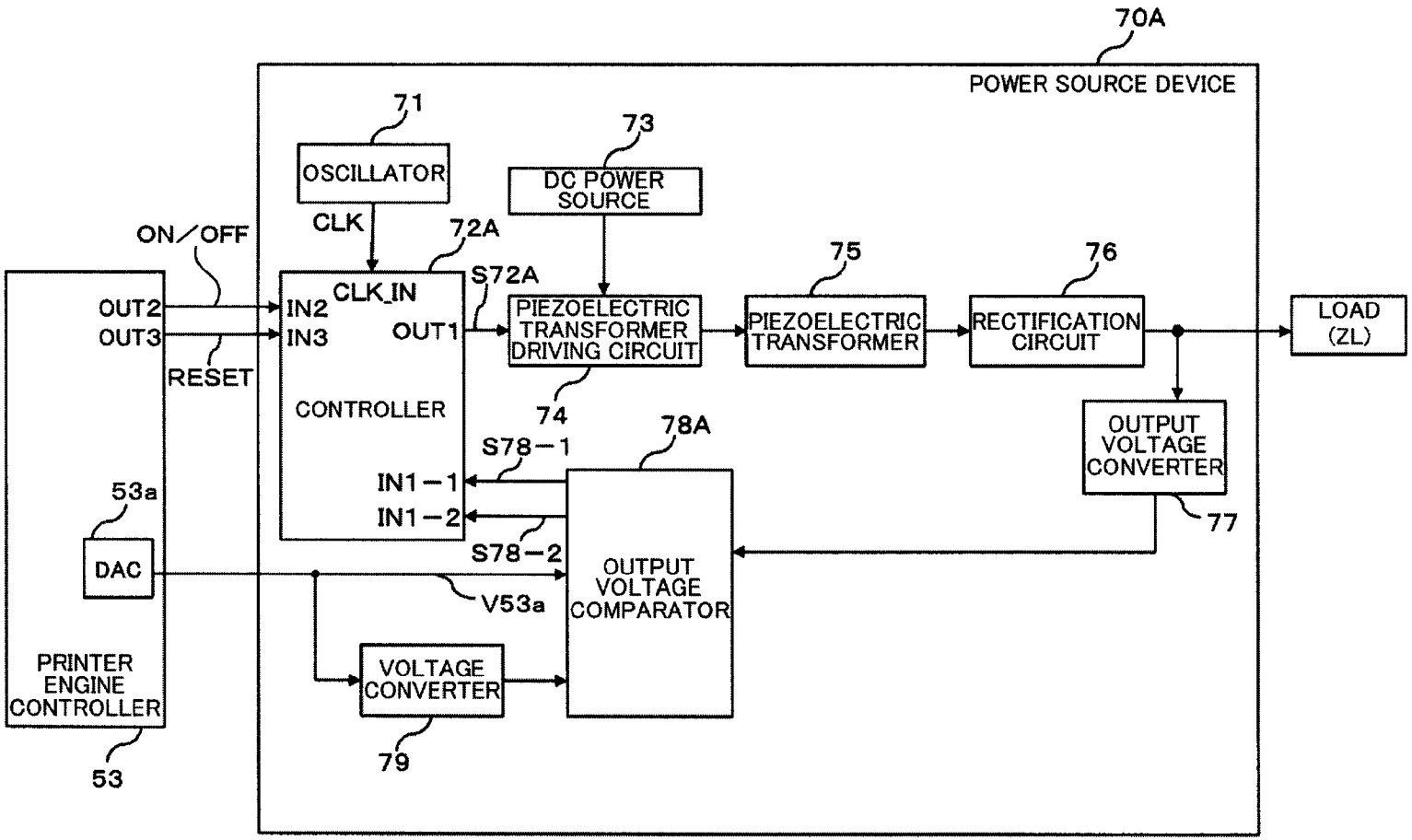
FIG. 11 is a schematic block diagram illustrating a power source device according to a second embodiment of the present invention.

Referring to FIG. 11, the power source device 70A is illustrated in a schematic diagram, and like components are given the same reference numerals as the power source device 70 of the first embodiment, and the description thereof is omitted.

The power source device 70A of the second embodiment is disposed with respect to each of four colors as similar to the first embodiment. Since each of the power source devices 70A is substantially similar to one another except for the color of toner, a description of the power source devices 70A is hereafter given by using the power source device 70A having one set of the circuit as representative of the power source devices 70A. As illustrated in FIG. 11, the power source device 70A includes a controller 72A and a comparator (e.g., an output voltage comparator) 78A differed from the controller 72 and the output comparator 78 of the first embodiment, respectively. The power source device 70A further includes a second target voltage setting unit (e.g., a voltage converter) 79.

The controller 72A of the second embodiment operates by synchronization with a clock (hereafter abbreviated as CLK) supplied from an oscillator 71. The controller 72A, serving as a circuit, outputs a driving pulse S72A by being controlled by a printer engine controller 53. The controller 72A includes a clock input port CLK_IN, an input port IN2, a reset input port IN3, and an output port OUT1 outputting the driving pulse S72A as similar to the first embodiment. Moreover, the controller 72A includes input ports IN1-1, IN1-2 respectively receiving inputs of comparison results S78-1, S78-2 of two channel unlike the input port IN1 of one channel as described above in the first embodiment. The controller 72A includes an ASIC, a microprocessor having a CPU therein, or FPGA. The output voltage comparator 78A includes two channels and compares: an output voltage of an output voltage converter 77 with a target voltage V53*a* output from a first target voltage setting unit (e.g., a DAC) 53*a* disposed inside the printer engine controller 53*a*; and the output voltage of the output voltage converter 77 with an output voltage of the voltage converter 79. The output voltage comparator 78A outputs the comparison results S78-1, S78-2 of the two channels to the respective input ports IN1-1, IN1-2 of the controller 72A based on the comparison.

Figure 12:
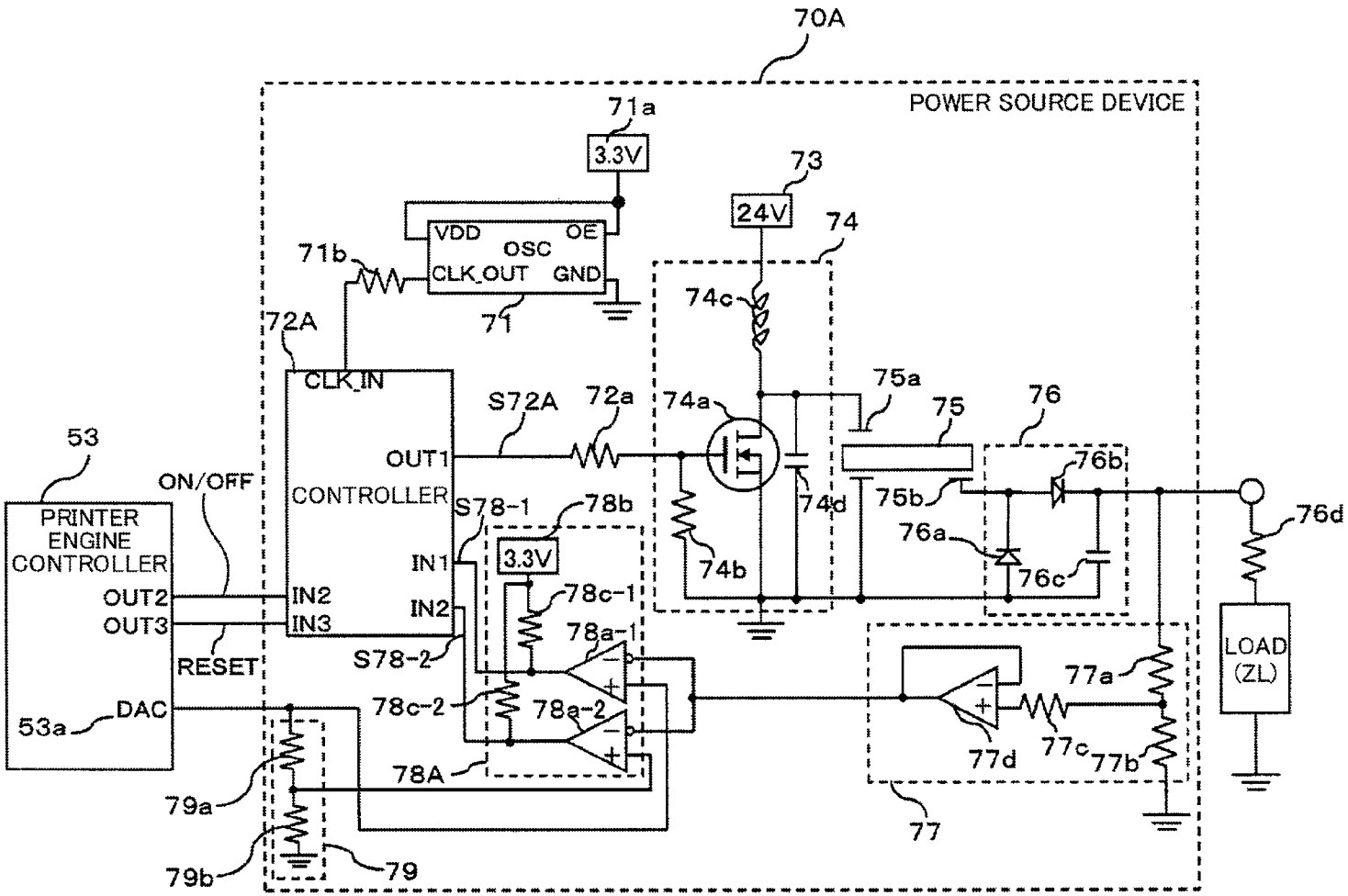
FIG. 12 is a circuit diagram illustrating the power source device of FIG. 11 in detail.

Referring to FIG. 12, the power source device 70A of FIG. 11 is illustrated in detail in a circuit diagram, and like components will be given the same reference numerals as above in FIG. 2.

The output voltage comparator 78A includes: comparators 78*a*-1, 78*a*-2 of the two channels; a power source 78*b* having a voltage of DC 3.3 V; and two pull-up resistances 78*c*-1, 78*c*-2. The comparator 78*a*-1 includes: an input terminal "−" or negative input terminal receiving an input of the output voltage of the output voltage converter 77; and an input terminal "+" or positive input terminal receiving an input of the target voltage V53*a* output from the DAC 53*a*. The comparator 78*a*-1 includes the negative and positive input terminals having an output terminal connected not only to the power source 78*b* having the voltage of DC 3.3 V through the pull-up resistance 78*c*-1 but also to the input port IN1-1 of the controller 72A. Another comparator 78*a*-2 includes: an input terminal "−" or negative input terminal receiving an input of the output voltage of the output voltage converter 77; and an input terminal "+" or positive input terminal receiving an input of the output voltage of the voltage converter 79. The comparator 78*a*-2 includes the negative and positive input terminals having an output terminal connected not only to the power source 78*b* having the voltage of DC 3.3 V through the pull-up resistance 78*c*-2 but also to the input port IN1-2 of the controller 72A.

The voltage converter 79 includes a constant voltage circuit, for example, having two division resistances 79*a*, 79*b* dividing the target voltage V53*a* output from the DAC 53*a*. The two division resistances 79*a*, 79*b* are connected in series between an output terminal of the DAC 53*a* and a ground. A resistance value of the division resistance 79*b* is twice as much as that of the division resistance 79*a*. The target voltage V53*a* output from the DAC 53*a* is divided to a level of ⅔ by the two division resistances 79*a*, 79*b*, and is input to the positive input terminal of the comparator 78*a*-2.

Other components of the power source device 70A of the second embodiment are substantially similar to those of the power source device 70 of the first embodiment. Therefore, the description thereof is omitted for the sake of simplicity.

Figure 13:
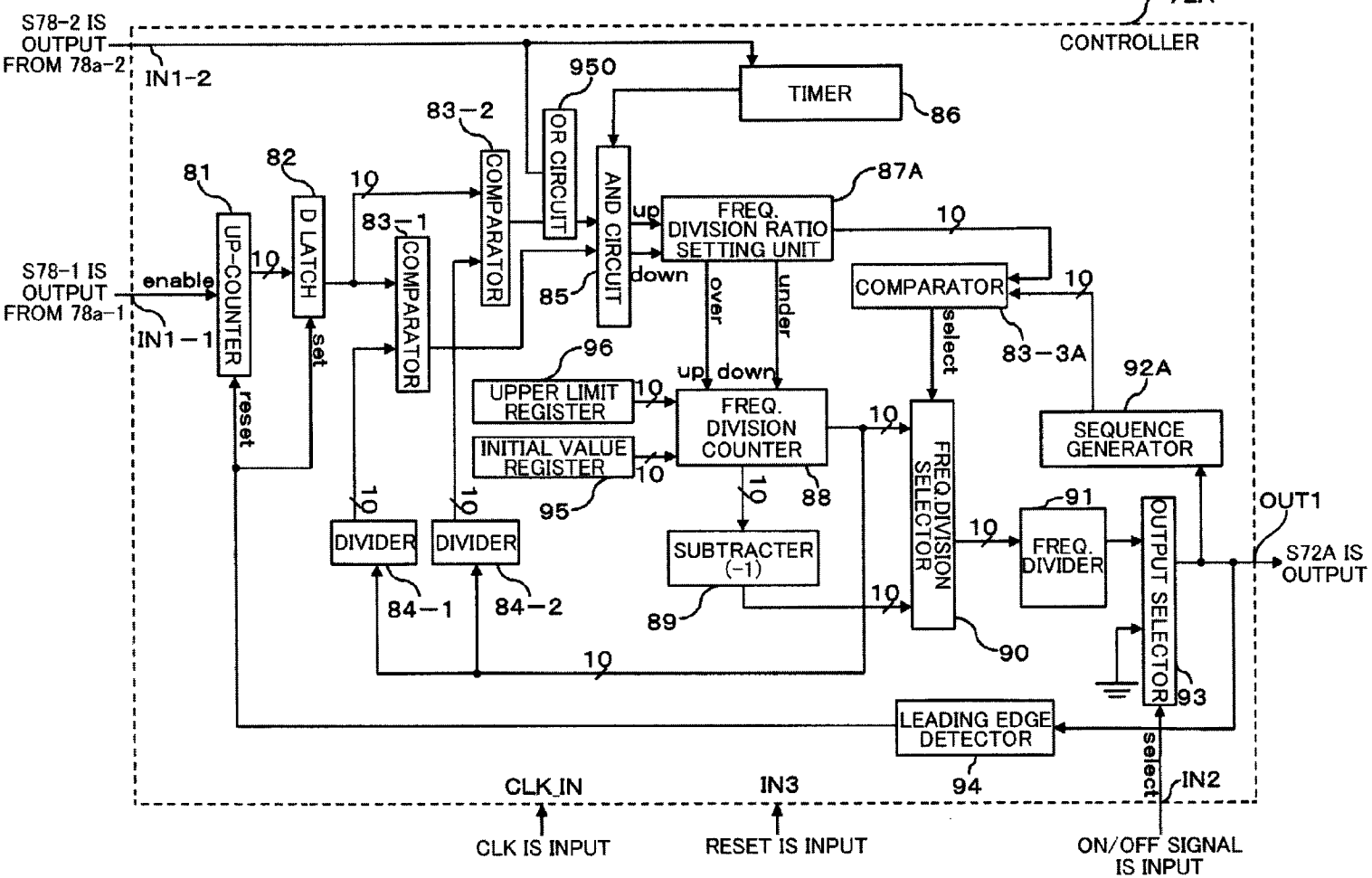
FIG. 13 is a schematic diagram illustrating a controller included in the power source device of FIG. 11.

Referring to FIG. 13, the controller 72A included in the power source device 70A is illustrated in a schematic diagram, and like components are given the same reference numerals as the controller 72 as illustrated in FIG. 6 of the first embodiment.

The controller 72A according to the second embodiment includes a frequency division ratio setting unit (e.g., a 10-bit counter) 87A, a third comparator 83-3A, and a sequence generator (e.g., a 10-bit sequence generator) 92A instead of the 6-bit counter 87, the third comparator 83-3, and the 6-bit sequence generator 92 of the first embodiment. The controller 72A according to the second embodiment further includes a logical sum circuit (hereafter referred to as an OR circuit) 950. The input port IN1-1, serving as a port, receives the input of the comparison result S78-1 and supplies to an up-counter 81. The input port IN1-2, serving as a port, receives the input of the comparison result S78-2 and supplies to the OR circuit 950 and a timer (e.g., a frequency divider) 86. The OR circuit 950 outputs the "H" level to an AND circuit 85 in a case where any of the comparison result S78-2 and a comparison result of a second comparator 83-2 is the "H" level.

The timer 86 outputs a pulse having a length of one clock to the AND circuit 85 for 6 cycles with respect to each 180 nsec while the comparison result S78-2 is being the "H" level. The timer 86 outputs a pulse having a length of one clock to the AND circuit 85 for 2400 cycles with respect to each 72 μsec. An initial value register 95, for example, has a value of 256 to be set. An upper limit register 96, for example, has a value of 301 to be set as similar to the first embodiment.

Other components of the controller 72A in the power source device 70A of the second embodiment are substantially similar to those of the controller 72 of the first embodiment, and the description thereof is omitted for the sake of simplicity.

The image forming apparatus and the control circuit according to the second embodiment operate similar to the image forming apparatus 1 and the control circuit of the first embodiment except for the operation described below.

The controller 72A has an additional input port, that is, the input port IN1-2, as illustrated in FIG. 11 compared to the controller 72 of the first embodiment as illustrated in FIG. 1. The output voltage comparator 78A compares: the output voltage of the output voltage converter 77 with the target voltage V53*a* output from the DAC 53*a* disposed inside the printer engine controller 53; and the output voltage of the output voltage converter 77 with a voltage provided by dividing the target voltage V53*a* to ⅔ by the voltage converter 79. The output voltage comparator 78A inputs the comparison results S78-1, S78-2 to the respective input ports IN1-1, IN1-2 of the controller 72A. Herein, the comparison result S78-1 is provided by comparing the output voltage of the output voltage converter 77 and the target voltage V53*a*, and the comparison result S78-2 is provided by comparing the output voltage of the output voltage converter 77 and the voltage provided by dividing the target voltage V53*a* to ⅔.

The comparison result S78-1 input to the input port IN1-1 of the controller 72A is used as a signal for the constant voltage control as similar to the first embodiment. The comparison result S78-2 is switched to the "L" level when the voltage having ⅔ of the target voltage V53*a* is reached before the comparison result S78-1 is switched to the "L" level upon reaching the target voltage V53*a*. The controller 72A allows a cycle in which an average frequency of the driving pulse S72A output from an output node OUT1 fluctuates to be shorten during a period of the "H" of the comparison result S78-2, thereby shortening the time necessary to obtain the frequency to reach the target voltage V53*a* compared to the first embodiment. Accordingly, the controller 72A allows a drive start frequency to be increased to 130.21 kHz, thereby capable of outputting the high voltage output being relatively low.

The printer engine controller 53 includes the DAC 53*a* having resolving power of 10-bit and a voltage of 3.3 V to correspond to a pre-bias of 600 V at a DAC value of 0.30 V, and sets 05DH in the DAC 53*a*. Subsequently, the printer engine controller 53 allows the reset signal "RESET" output from the output port OUT3 to be the "L" level, thereby initializing the register and the like disposed inside the controller 72A as similar to the first embodiment.

The printer engine controller 53 begins printing operation. After each of photosensitive drums 32 (i.e., 32K, 32Y, 32M, and 32C) and a transfer belt driving roller 6 are driven, the printer engine controller 53 allows an ON/OFF signal output from the output port OUT2 to be the "H" level, so that a transfer output is turned ON. For example, since the DAC 53*a* has the resolving power of the 10-bit and the voltage of 3.3V to correspond to a transfer bias of 5 kV at a DAC value of 2.5 V, a value of the target voltage V53*a* output from the DAC 53*a* is set to be 307H at a prescribed timing at which a recording medium 15 is conveyed as similar to the first embodiment after the pre-bias of 600 V is applied by the controller 72A. The controller 72A controls the average frequency of the driving pulse S72A output from the output port OUT1 according to the values of the input port IN1-1, IN1-2 receiving the inputs of the respective comparison results S78-1, S78-2 of the comparators 78*a*-1, 78*a*-2, and the setting value of 2.5 V for the DAC 53*a*, thereby outputting the transfer bias of 5 kV. Consequently, the ON/OFF signal becomes the "L" level at a prescribed timing at which a sheet detection sensor 40 detects a tailing end of the recording medium 15, so that the driving pulse S72A output from the controller 72A halts, and application of the high voltage bias ends.

A description is now given of operation of the controller 72A with reference to FIG. 13. The DAC 53*a* outputs the target voltage V53*a* of 0.3 V as the pre-bias, the voltage of 0.3 V is input to the positive input terminal of the comparator 78*a*-1 of FIG. 12, and the divided voltage of 0.2 V is input to the positive input terminal of the comparator 78*a*-2. The reset signal "RESET" to be input to the input port IN3 is set to be the "L" level beforehand, so that the register inside is initialized as similar to the first embodiment, and a value of 256 set in the initial value register 95 is set in the frequency division counter 88.

In a case where the ON/OFF signal input to the input port IN2 is switched to the "H" level by the printer engine controller 53 at the prescribed timing, the piezoelectric transformer 75 is driven. Since the piezoelectric transformer 75 has the driving frequency of 130.21 kHz and the high voltage output of 100 V or below at the beginning of driving, the comparison results S78-1, S78-2 output from the respective comparators 78*a*-1, 78*a*-2 become the "H" level. Consequently, the OR circuit 950 has the output signal having the "H" level, and the timer 86 has the comparison result S78-2 of the comparator 78*a*-2 having the "H" level to be input to the AND circuit 85, so that the 10 bit counter 87A has a count value updated with respect to each 180 nsec, thereby reducing the average frequency of the output pulse of the frequency divider 91 as similar to the first embodiment.

The lower the driving average frequency, the higher the voltage output. In a case where the high voltage output exceeds 400 V, the comparison result S78-2 of the comparator 78*a*-2 becomes the "L" level. The timer 86 has an input having the "L" level, and a pulse cycle input to the AND circuit 85 is changed to 72 μsec, so that the count value of the 10-bit counter 87A is changed, and the high voltage output is controlled to the constant voltage of 600 V as similar to the first embodiment according to the output states of the first and second comparators 83-1, 83-2.

Subsequently, the value of the target voltage V53*a* output from the DAC 53*a* is changed to 2.5 V at the prescribed timing, so that a target high voltage output is set to be 5 kV. Consequently, the comparison result S78-2 of the comparator 78*a*-2 becomes the "H" level again, and the count-up cycle of the 10-bit counter 87A becomes 180 nsec cycle as similar to the above. In a case where the high voltage output becomes 3.334 kV, the comparison result S78-2 of the comparator 78*a*-2 becomes the "L" again, the count-up cycle of the 10-bit counter 87A is changed to 72 μsec as similar to the above, then, performing the constant voltage control to 5 kV as similar to the first embodiment.

The ON/OFF signal is switched to the "L" level at the prescribed timing, thereby turning OFF the high voltage output. According to the second embodiment, the piezoelectric transformer driving circuit 74 has the high voltage output having a frequency characteristic as schematically illustrated in FIG. 5 as similar to the first embodiment As illustrated in FIG. 5, the high voltage output has the maximum value HV2 at a resonance frequency "fx" and the minimum value at a frequency "fy." In case where the frequency is increased from the "fy" to "fz," the high voltage output exceeds 1 kV. The frequency "fz" is referred to as a spurious frequency. In a case of using a related art circuit having a voltage-controlled oscillator (hereafter referred to as a VCO), an oscillation start frequency becomes higher than the spurious frequency "fz," causing an increase in difficulty of controlling the high voltage output to be lower than the spurious voltage HV1 of FIG. 5. For example, in a case where the pre-bias is applied at a target voltage which is lower than the spurious voltage HV1, the frequency is controlled to be higher than the frequency "fz." Herein, in a case where such frequency higher than the "fz" is switched to the transfer voltage higher than the spurious voltage HV1, the high voltage output is once decreased by several hundred voltages and then reaches the target voltage if the frequency is controlled to be below the frequency "fz." Consequently, the related art circuit causes deterioration of the high voltage output and prolongation of the rise time or leading edge time. According to the second embodiment, on the other hand, the digital circuit is capable of optionally setting the start frequency, thereby reducing the deterioration of the high voltage output and prolongation of the rise time or leading edge time.

In addition to the modifications similar to the first embodiment, the second embodiment can be modified as follows.

According to the second embodiment, the comparators 78*a*-1, 78-2 of the two channels are used to set the target voltage V53*a* and the frequency switching voltage which is smaller than or equal to the target voltage V53*a*. However, the selection of the target voltage V53*a* and the frequency switching voltage may be input the controller 72A using the TTL signal and the like, and the output of the DAC 53*a* may be switched to the target voltage V53*a* and the frequency switching voltage using the comparator output as one channel.

According to the second embodiment, the frequency switching voltage is set to be ⅔ of the target voltage V53*a* at the time of rising. However, the frequency switching voltage is not limited thereto, and an appropriate value thereof may vary depending upon a circuit characteristic and the like. Moreover, the frequency switching voltage may shift using the DAC and the like.

According to the second embodiment, the frequency change or shift cycle at the time of the rising period is changed according to the setting value of the timer 86. However, frequency change steps may be applied. For example, plural steps of the 10-bit may be applied only at the time of the high voltage output rising, or the frequency resolving power may be set to a bit number smaller than the 10-bit only at the time of the rising. According to the second embodiment, the value of 10-bit is applied. However, the value is not limited thereto.

The comparison results S78-1, S78-2 of the respective comparators 78*a*-1, 78*a*-2 allow the frequency at the time of the rising period to be switched before the constant voltage control is performed. However, the comparison results S78-1, S78-2 may allow a target voltage value for the constant voltage control to be controlled, and the output voltage of the output voltage converter 77 may be input to, for example, the DAC 53*a* of the printer engine controller 53 at the time of the high voltage output rising. Consequently, the printer engine controller 53 may output the signal to the controller 72A according to the input value of the DAC 53*a*, allowing the frequency at the time of the rising to be switched.

According to the second embodiment, each of the controller 72A and the printer engine controller 53 includes the CPU. However, the controller 72A and the printer engine controller 53 may be formed in one chip. The FPGA and the like may be applied instead of the controller 72A.

Therefore, the second embodiment provides following advantages. The signal for the constant voltage control and the signal for the high voltage output rising are used, so that the rise time or leading edge time can be quickly shifted using different constants at the times of the constant voltage control and the high voltage output rising, and the constant voltage control can be stably performed around the resonance frequency. Moreover, the start frequency at the beginning of the high voltage output is set to be lower than the spurious frequency "fz," so that the linear output can be obtained from the high voltage output relatively lower than the output voltage at the spurious frequency "fz" to the high output voltage around the resonance frequency "fx."

Third Embodiment

An image forming apparatus, a control circuit, and a power source device according to a third embodiment are substantially similar to the image forming apparatus 1 of FIG. 3, the control circuit of FIG. 4, and the power source device 70 of FIG. 1 and FIG. 2 according to the first embodiment described above except for a controller 72B. A description is now given of the controller 72B of the third embodiment Referring to FIG. 14, the controller 72B disposed inside the power source device 70 according to the third embodiment of the present invention is illustrated in a schematic diagram. Components similar to the first embodiment are given the same reference numerals.

The controller 72B of the third embodiment includes a frequency division ratio setting unit (e.g., a 6-bit counter) 87B and a sequence generator (e.g., a 6-bit pseudo random number generator) 92B instead of the 6-bit counter 87 and the 6-bit sequence generator 92 in the controller 72 of the first embodiment described above.

The 6-bit counter 87B, serving as a counter, counts up and down in response to the output of an AND circuit 85. According to the first embodiment, the 6-bit counter 87 counts between zero (0) and 63. According to the third embodiment, on the other hand, the 6-bit counter 87B counts between 1 and 63. For example, in a case of counting up from 63, an over flow signal "over" is output, and the counter 87B is set to be one (1). In a case of counting down from the value 1, an under flow signal "under" is output, and 63 is set. In a case of other situations, the counting up and down is performed by the value 1. The 6-bit pseudo random number generator 92B changes pseudo random number values of 1 through 63 with respect to each pulse output from the output selector 93. Other components are similar to the first embodiment, and a description thereof is omitted for the sake of simplicity.

Figure 14:
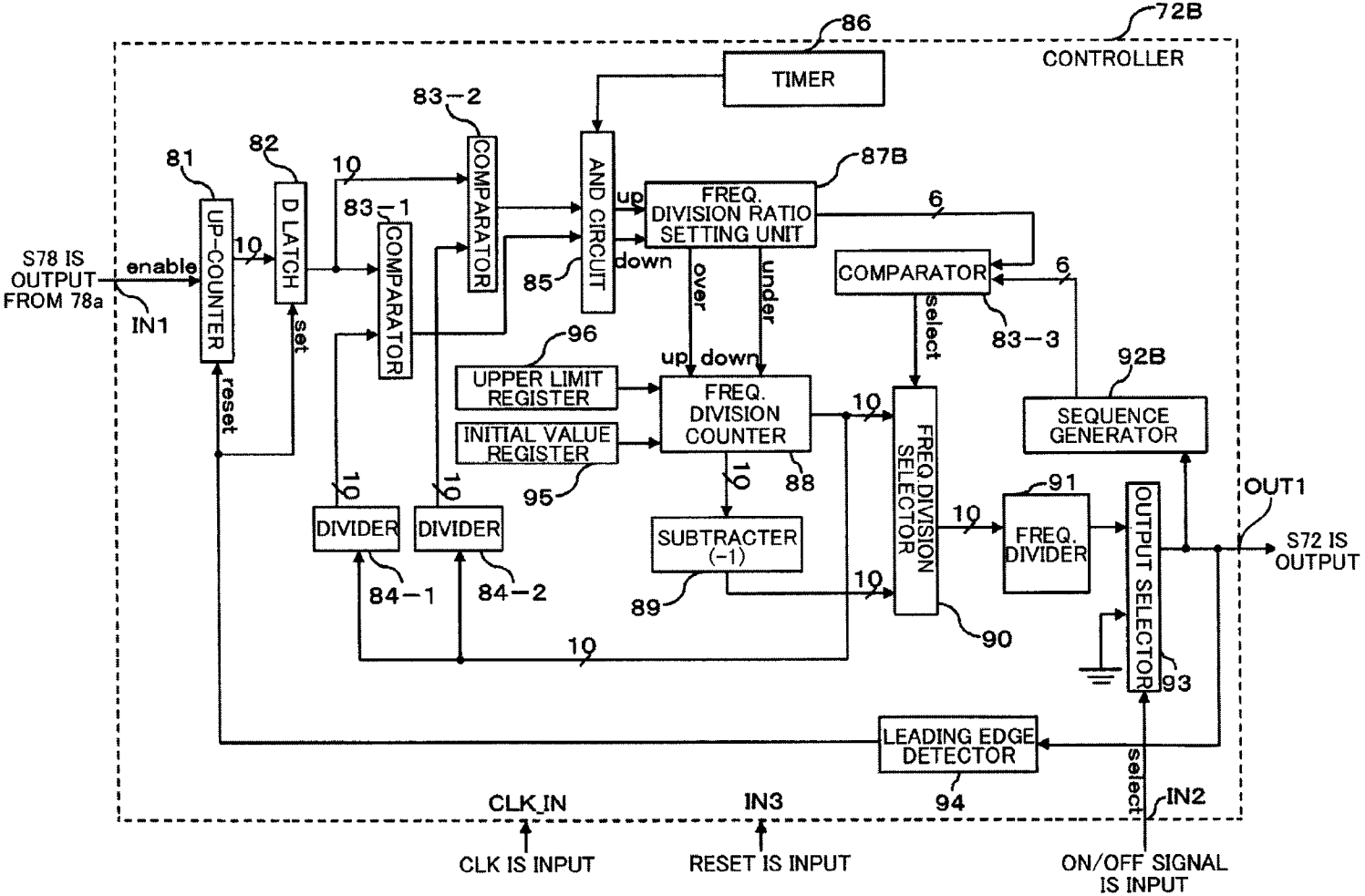
FIG. 14 is a schematic diagram illustrating a controller included in a power source device according to a third embodiment of the present invention.
Figure 15:
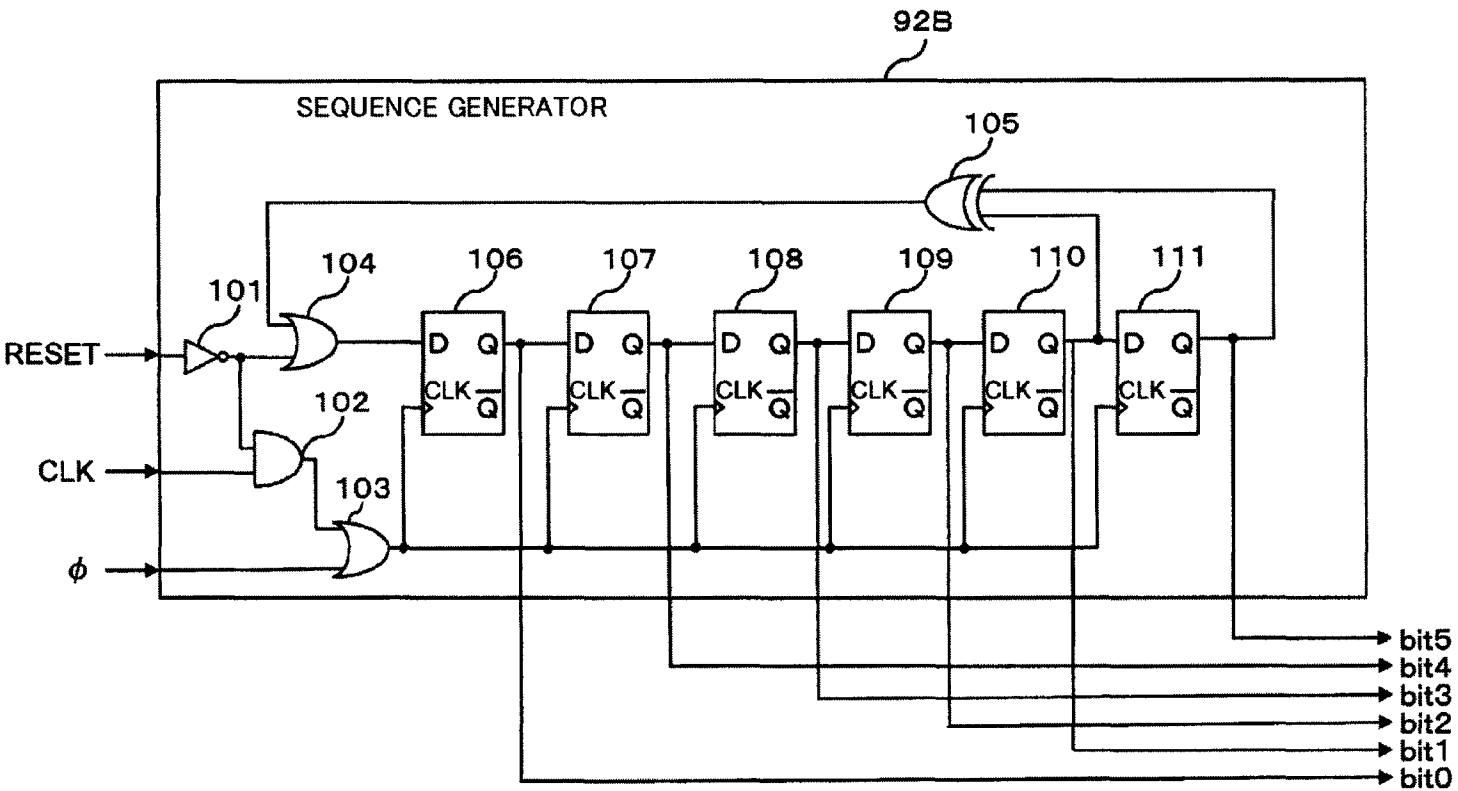
FIG. 15 is a schematic diagram illustrating a sequence generation unit included in the controller of FIG. 14.

Referring to FIG. 15, the 6-bit pseudo random number generator 92B included in FIG. 14 is illustrated in a schematic diagram. The 6-bit pseudo random number generator 92B, for example, includes: a linear feedback shift register (hereafter referred to as an LFSR); a NOT gate 101 reversing the reset signal "RESET"; a two-input AND gate 102 determining a logical conjunction of the output signal of the NOT gate 101 and a clock (hereafter abbreviated as a CLK); a two-input OR gate 103 determining a logical sum of the output signal of the AND gate 102 and a pulse ϕ; an OR gate 104, receiving two inputs, connected to an output side of the NOT gate 101; an exclusive disjunction (hereafter referred to as an XOR) gate 105, receiving two inputs, connected to an input side of the OR gate 104; six stages of delay flip flops (hereafter referred to as DFF) 106 through 111 sequentially connected between the output sides of the OR gates 103, 104 and the input side of the OR gate 105.

A description is given of the operation of the controller 72B according to the third embodiment. The driving pulse S72 has states (e.g., an integer portion N and decimal portions 36/63 through 39/63) in the frequency division operation of the controller 72B of the third embodiment as illustrated in timing diagrams of FIG. 16A through FIG. 16D. Herein, the timing diagrams FIG. 16A through FIG. 16D correspond to states (e.g., the integer portion N and the decimal portions 36/63 through 39/63) of a pulse not shown in the timing diagrams of FIG. 9A through FIG. 9G of the first embodiment.

The operation of the controller 72B differed from that of the controller 72 of the first embodiment is only described for the sake of simplicity.

The controller 72B of the third embodiment includes the 6-bit pseudo random number generator 92B receiving the CLK running at the frequency of 33.33 MHz input to each of CLK input terminals of the DFF 106 through DFF 111 by opening the AND gate 102 and the OR gate 103 according to the signal "H" output from the NOT gate 101 in a case where the reset signal "RESET" becomes the "L" level, and the 6-bit pseudo random number generator 92B is reset. While the CLK is being input, the signal "H" is input to an input terminal "D" of the DFF 106 through the OR gate 104, so that the reset signal "RESET" input is held for a prescribed time period. Consequently, each of output terminals "Q" of the DFF 106 through DFF 111 becomes the "H" level, thereby setting an initial value.

After the reset signal "RESET" becomes the "H" level, the values of respective DFF 106 through DFF 111 are shifted with respect to each input of the pulse ϕ, and a pseudo random number sequence having the bit zero (0) through the bit 5 for 1 through 63 are output as follows.

63, 62, 46, 38, 34, 32, 1, 16, 8, 4, 2, 33, 17, 24, 12, 6, 35, 48, 9, 20, 10, 37, 19, 57, 29, 30, 47, 54, 42, 36, 3, 49, 25, 28, 14, 39, 50, 40, 5, 18, 41, 21, 26, 45, 23, 59, 60, 15, 55, 58, 44, 7, 51, 56, 13, 22, 43, 52, 11, 53, 27, 61, and 31.

The controller 72B of the third embodiment operates similar to the controller 72 of the first embodiment except for the sequence and cycle of the counter differed by one.

Figure 16A:
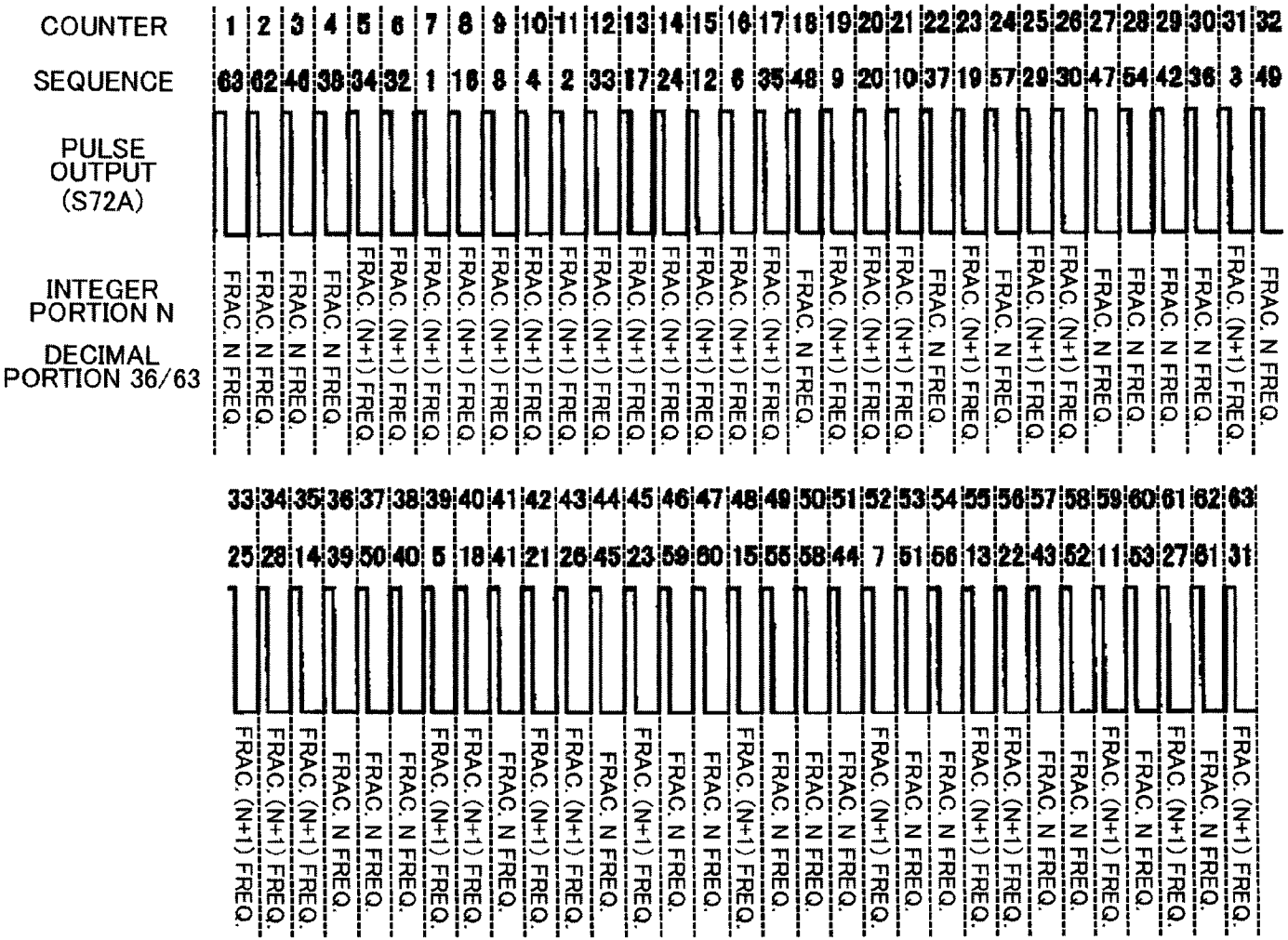
FIGS. 16A, 16B, 16C, and 16D are schematic timing diagrams illustrating a state of a driving pulse in frequency division operation of the controller of FIG. 14.
Figure 16B:
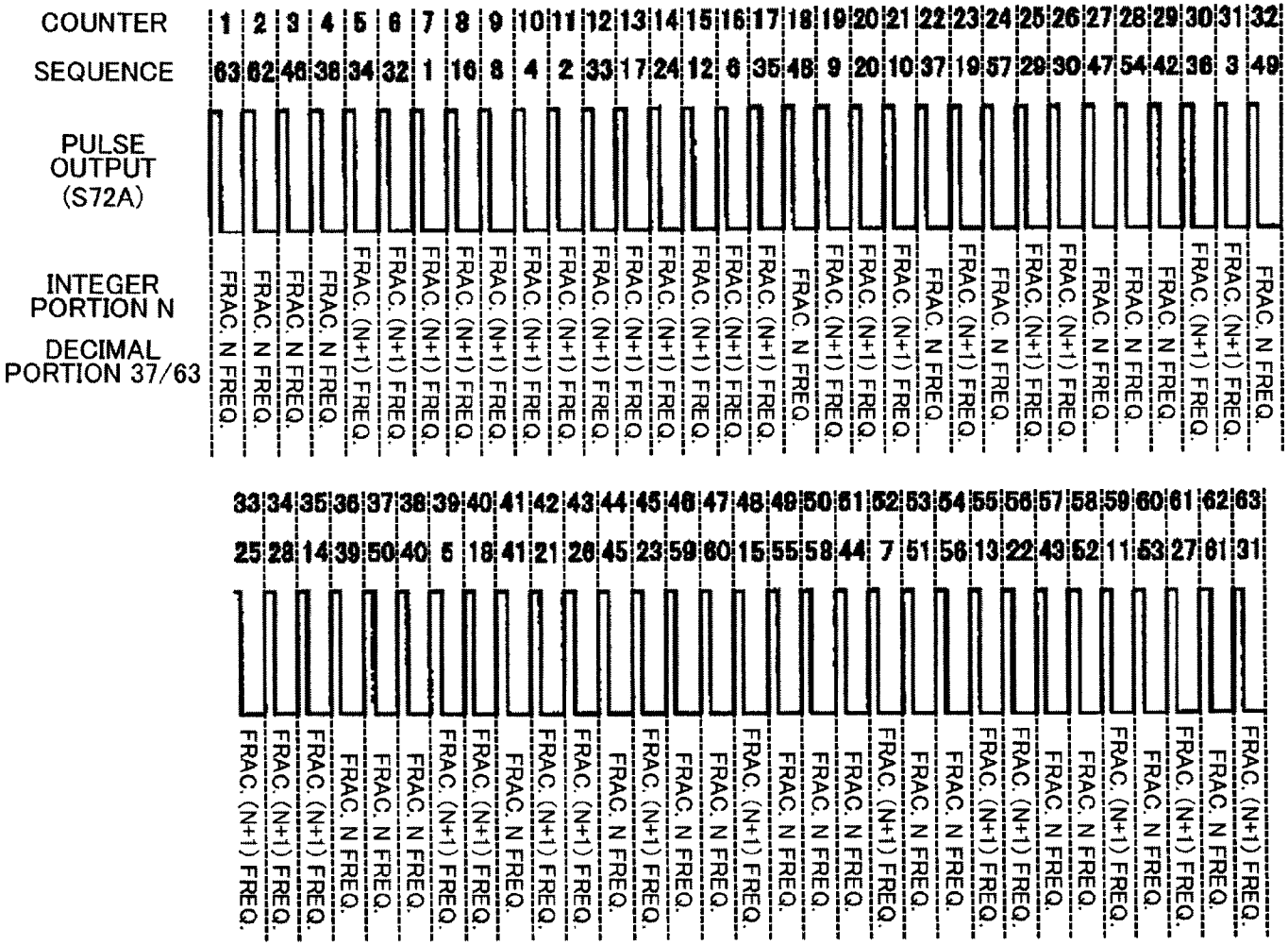
Figure 16C:
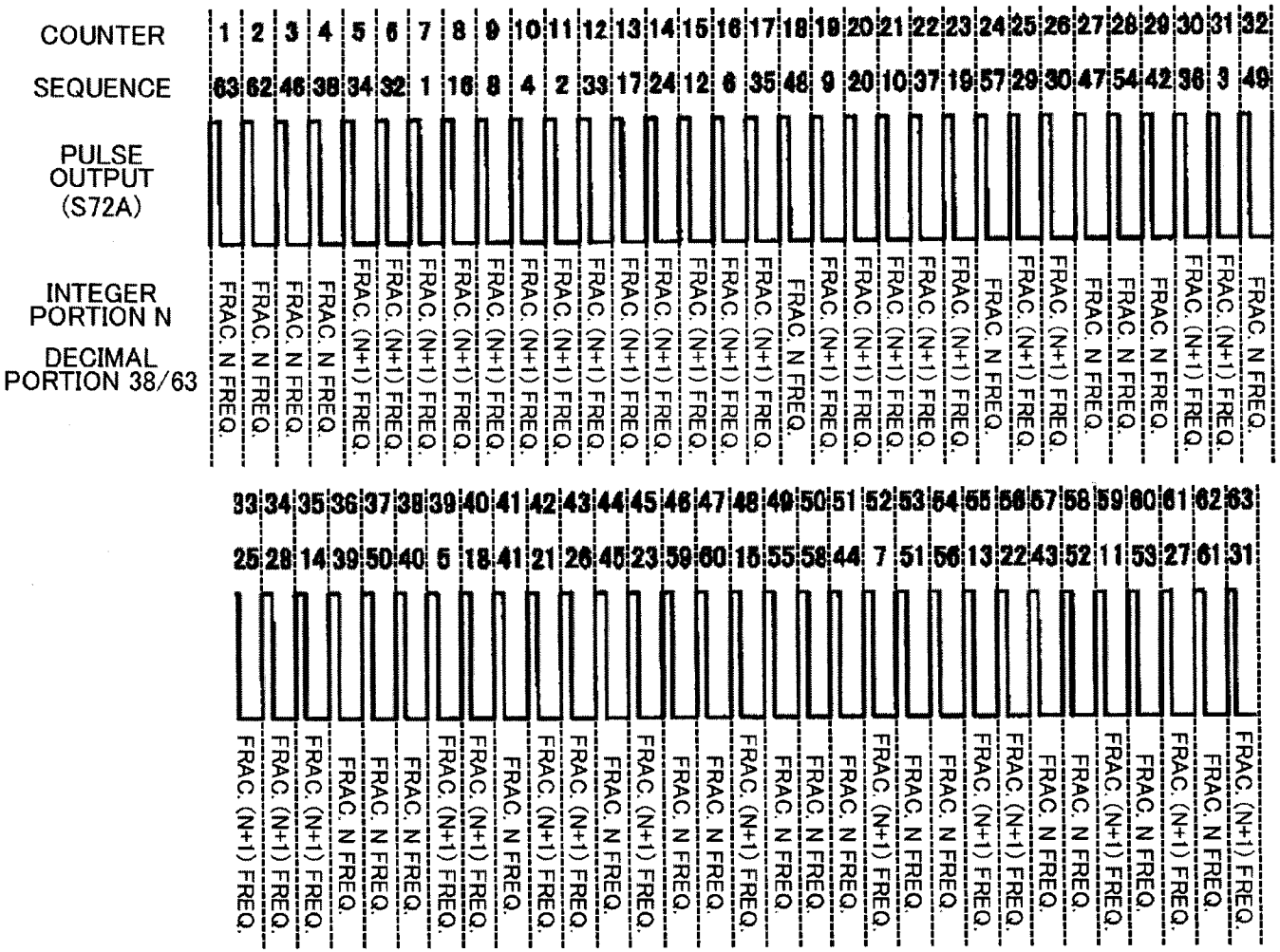
Figure 16D:
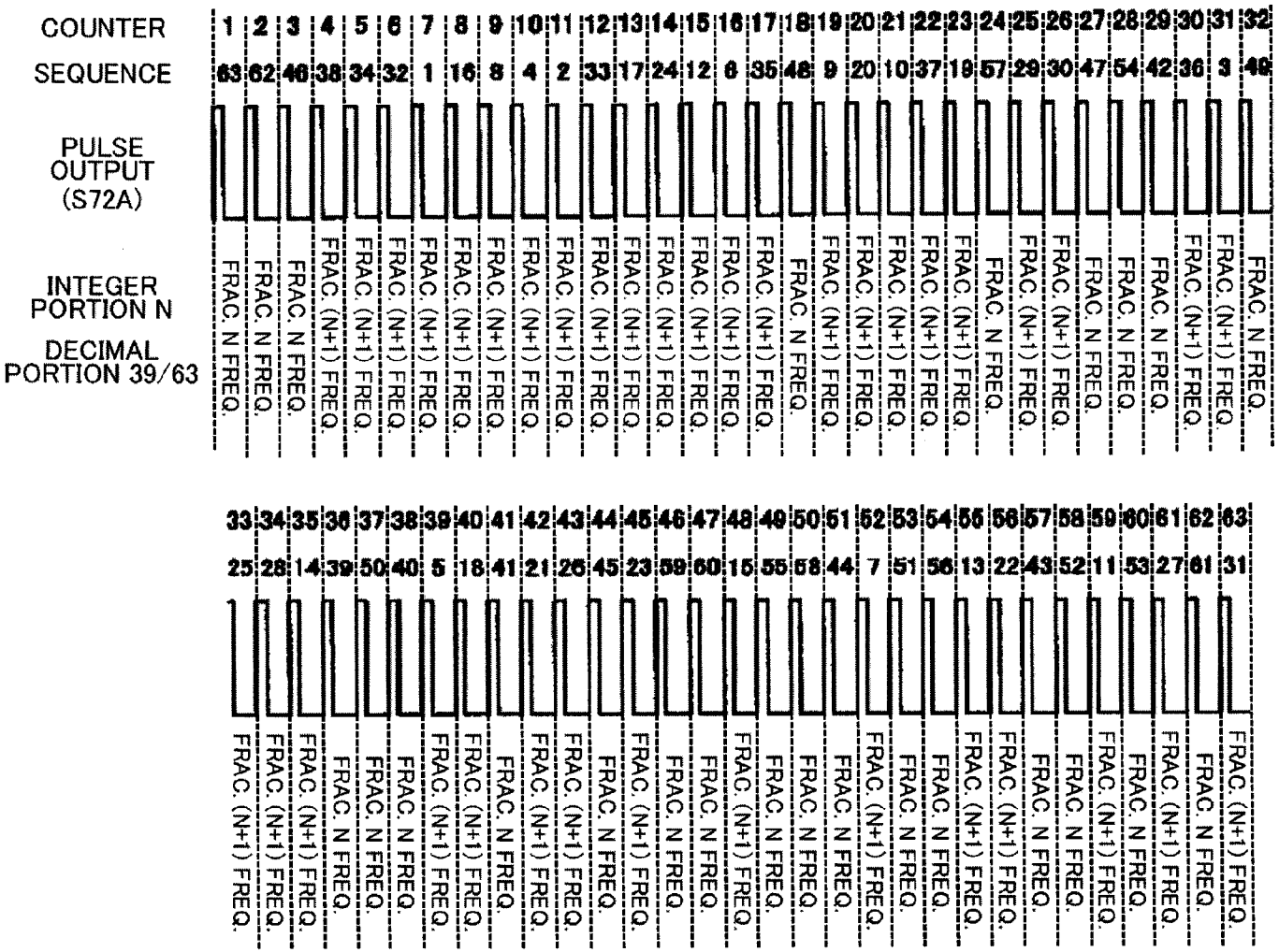

The timing charts of FIG. 16A through FIG. 16D correspond to the pulse states (e.g., the integer portion N and the decimal portions 36/63 through 39/63) in the timing charts of FIG. 9A through FIG. 9G. For example, in a case where the decimal portion is 37/63 as illustrated in FIG. 16B, the average frequency has 63 pulses. Herein, the cycle is shifted by follows:

$$\{27\times N+36\times(N+1)\}/63=N+36/63=N+0.57143$$

In a case where the average frequency is reduced by half to 32 pulses, the cycle is shifted as follows.

$$\{11\times N+21\times(N+1)\}/32=N+21/32=N+0.65625$$

In a case where the average frequency is further reduced by half to 16 pulses, the cycle is shifted as follows.

$$\{4\times N+12\times(N+1)\}/16=N+12/16=N+0.75$$

Herein, the average frequency becomes substantially the same. In a case where the average frequency has 8 pulses, the cycle is shifted as follows:

$$\{4\times N+4\times(N+1)\}/8=N+4/8=N+0.5$$

According to the third embodiment, the 6-bit pseudo random number generator 92B having the LFSR is used. However, the 6-bit pseudo random number generator 92B is not limited thereto.

According to the third embodiment, the 6-bit pseudo random number generator 92B having the LFSR and the like is used, so that the circuit is symplified, and an advantage similar to the first embodiment can be obtained.

Fourth Embodiment

An image forming apparatus, a control circuit, and a power source device according to a fourth embodiment are substantially similar to the image forming apparatus 1 of FIG. 3, the control circuit of FIG. 4, and the power source device 70A of FIG. 1 and FIG. 2 according to the second embodiment described above except for a controller 72C. A description is now given of the controller 72C of the fourth embodiment.

Figure 17:
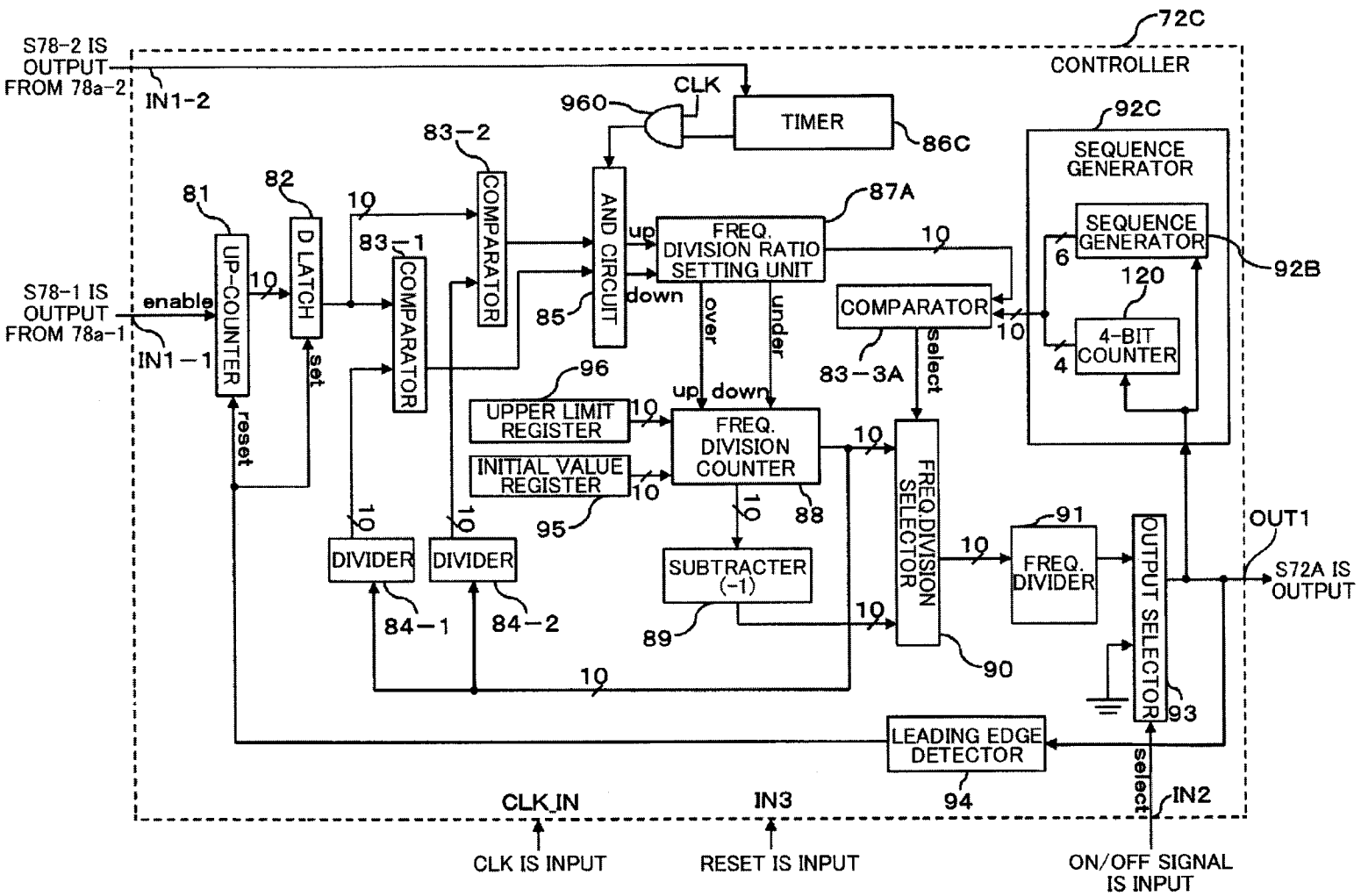
FIG. 17 is a schematic diagram illustrating a controller included in a power source device according to a fourth embodiment of the present invention.

Referring to FIG. 17, the controller 72C disposed inside a power source device 70C according to the fourth embodiment is illustrated in a schematic diagram, and like components are given the same reference numerals as the second embodiment.

According to the fourth embodiment, the controller 72C includes a timer (frequency divider) 86C, and a sequence generator (e.g., a 10-bit pseudo random number sequence generator) 92C instead of the timer 86 and the 10-bit sequence generator 92A of the second embodiment. The controller 72C further includes a two-input AND gate 960 implementing a logical conjunction of a clock (CLK) and an output signal of the timer 86C.

The timer 86C of the fourth embodiment operates different from the timer 86 of the second embodiment. According to the second embodiment, the cycle is changed according to the comparison result S78-2 of the comparator 78*a*-2. According to the fourth embodiment, on the other hand, duty is changed. As similar to the second embodiment, the cycle is 72 μsec according to the fourth embodiment. However, in a case where the comparator 78*a*-2 has the comparison result S78-2 having the "H" level, a period of "H" level has 400 clocks with 1.2 μsec. In a case where the comparator 78*a*-2 has the comparison result S78-2 having the "L" level, on the other hand, a period of "H" level has one pulse as similar to the second embodiment. Therefore, in a case where the comparator 78*a*-2 has the comparison result S78-2 having the "H" level, a 10-bit counter 87A is changed by 400 counts at one time in response to the comparison results of first and second comparator 83-1, 83-2 to be input to an AND circuit 85. The AND gate 960 implements the logical conjunction of the timer 86C and the CLK and outputs to the AND circuit 85.

The 10-bit counter 87A counts between 16 and 1023. In a case where 1023 is counted up by 1, the 10-bit counter 87A outputs an over flow signal "over," so that 16 is set. In a case where 16 is counted down by 1, the 10-bit counter 87A outputs an under flow signal "under," so that 1023 is set.

The 10-bit pseudo random number sequence generator 92C includes a 6-bit pseudo random number generator 92B similar to the above third embodiment and a 4-bit counter 120. The 4-bit counter 120 counts the driving pulse S72 output from an output selector 93, and switches a higher-order bit and lower-order bit. The 4-bit counter 120 outputs 0, 8, 4, 12, 2, 10, 6, 14, 1, 9, 5, 13, 3, 11, 7, and 15 in response to the change of the count value to 0, 1, 2, 3, 4, 5, 6, 7, 8, 9, 10, 11, 12, 13, 14, and 15, thereby generating the sequences of 16 through 1023 along with the output of the 6-bit pseudo random number generator 92B The operation of the controller 72C differed from that of the controller 72A of the second embodiment is only described for the sake of simplicity.

In the controller 72C of the fourth embodiment, the timer 86C becomes ON-duty having 400 CLKs while the comparison result S78-2 of the comparator 78*a*-*s* are being the "H" level. The AND gate 960 implements the logical conjunction of the CLK and the timer 86C, so that the timer 86C inputs the 400 pulses to the AND circuit 85 with respect to every 72 μsec. Consequently, the 10-bit counter 87A is counted up by 400 at one time. In a case where the comparator 78*a*-2 has the comparison result S78-2 having the "L" level, the timer 86C becomes the ON-duty having 1 CLK, thereby counting up and down the 10-bit counter 87A by 1.

According to the fourth embodiment of the present invention, the 10-bit pseudo random number sequence generator 92C allows a cycle of the pseudo random number to be shorter, for example, 6-bit, and allows a time converging to the frequency to be shorter, so that not only the frequency resolving power can be finer such as 10-bit, but also the circuit can have a reduced size.

The present invention is described above with reference to the first, second, third, and fourth embodiments with some modifications. However, the present invention is not limited thereto.

According to each of the first, second, third, and fourth embodiments of the present invention, the image forming apparatus 1 employing the tandem method is described. However, the present invention may be applied to a an image forming apparatus including a monochrome image forming apparatus, and a multi-functional peripheral, and the like. Moreover, the power source devices 70, 70A are used for the transfer operation in the above embodiments. However, the power source devices 70, 70A may be applied to a high voltage power source for the charging operation and the like.

As can be appreciated by those skilled in the art, numerous additional modifications and variation of the present invention are possible in light of the above-described teachings. It is therefore to be understood that, within the scope of the appended claims, the disclosure of this patent specification may be practiced otherwise than as specifically described herein.

What is claimed is:

1. A power source device comprising:

an oscillator generating a clock;

a frequency division unit dividing the clock to output a pulse;

a sequence generation unit generating an "N" number of sequences, in which each element has substantially the same occurrence rate, with respect to each switching of the pulse by synchronizing with the pulse;

a frequency division ratio setting unit setting a frequency division ratio of the pulse;

a switching element driven by the pulse; and a piezoelectric transformer outputting an alternating current high voltage from a secondary side thereof when a primary side thereof is intermittently applied with a voltage by the switching element, wherein the generated sequence and the set frequency division ratio are compared to output the pulse of a fractional-M frequency and the pulse of a fractional-M+1 frequency, wherein an average frequency division ratio of the pulse of the fractional M frequency and the pulse of the fractional-M+1 frequency is determined by $(M\times\alpha)+(M+1)\times\beta/(\alpha+\beta)$, where the $\alpha$ represents the number of the pulses of the fractional-M frequency and the $\beta$ represents the number of the pulses of the fractional-M+1 frequency per unit time, and wherein the average frequency division ratio and the frequency division ratio become substantially equal to each other at a generation cycle of the sequence, and become approximated to each other in a period shorter than the sequence generation cycle.

2. The power source device according to claim 1, further comprising:

a rectification unit converting the alternating current high voltage into a direct current high voltage;

an output voltage conversion unit converting the direct current high voltage into a direct current low voltage;

a first target voltage setting unit setting a first target voltage; and a comparison unit comparing the direct current low voltage with the set first target voltage to output a comparison result, wherein the set frequency division ratio is changed by the comparison result, and constant voltage control is performed such that a signal waveform of the comparison result becomes a rectangular wave at an output cycle of the pulse.

3. The power source device according to claim 2, wherein a cycle of changing the set frequency division ratio is shorter than the sequence generation cycle of the sequence generation unit.

4. The power source device according to claim 2, further comprising a second target voltage setting unit setting a second target voltage lower than the first target voltage, wherein a cycle of changing the set frequency division ratio is shorter than that at a time of the constant voltage control until the set second target voltage.

5. The power source device according to claim 2, further comprising a second target voltage setting unit setting a second target voltage lower than the first target voltage, wherein a change rate of changing the set frequency division ratio is greater than that at a time of the constant voltage control until the set second target voltage.

6. The power source device according to claim 2, further comprising a second target voltage setting unit setting a second target voltage lower than the first target voltage, wherein a rate of changing the set frequency division ratio and a cycle of changing the frequency division ratio are greater than those at a time of the constant control until the set second target voltage.

7. The power source device according to claim 2, wherein the first target voltage setting unit includes a variable voltage output circuit.

8. The power source device according to claim 2, wherein the second target voltage setting unit includes a constant voltage circuit.

9. The power source device according to claim 1, wherein the sequence generation unit includes a count unit counting the pulse divided to output plural-bit output signals, and generates the sequence by switching a bit arrangement of the output signals.

10. The power source device according to claim 1, wherein the sequence generation unit includes a count unit counting the pulse divided to output plural-bits output signals bit0, bit1, . . . , bitN−1, and bitN, and generates the sequences of bitN, bitN−1, . . . , bit1, and bit0 by switching the output signals bit0, bit1, . . . , bitN−1, and bit N upside down.

11. The power source device according to claim 1, wherein the sequence generation unit includes a pseudo random number generator generating an optional sequence.

12. The power source device according to claim 1, wherein the sequence generation unit includes:

a pseudo random number generator generating an optional sequence; and a counter counting the pulse divided to output a plural-bit output signal, wherein the sequence generation unit generates the sequence by mixing the optional sequence and the output signal.

13. The power source device according to claim 1, wherein the "N" is an integer, the M is a positive integer, the $\alpha$ is a positive number, and the $\beta$ is a positive number.

14. An image forming apparatus forming an image, the image forming apparatus comprising a power source device, the power source device including:

an oscillator generating a clock;

a frequency division unit dividing the clock to output a pulse;

a sequence generation unit generating an "N" number of sequences, in which each element has substantially the same occurrence rate, with respect to each switching of the pulse by synchronizing with the pulse;

a frequency division ratio setting unit setting a frequency division ratio of the pulse;

a switching element driven by the pulse; and a piezoelectric transformer outputting an alternating current high voltage from a secondary side thereof when a primary side thereof is intermittently applied with a voltage by the switching element, wherein the generated sequence and the set frequency division ratio are compared to output the pulse of a fractional-M frequency and the pulse of a fractional-M+1 frequency wherein an average frequency division ratio of the pulse of the fractional-M frequency and the pulse of the fractional-M+1 frequency is determined by $(M\times\alpha)+(M+1)\times\beta/(\alpha+\beta)$, where the $\alpha$ represents the number of the pulses of the fractional-M frequency and the $\beta$ represents the number of the pulses of the fractional-M+1 frequency per unit time, and wherein the average frequency division ratio and the frequency division ratio become substantially equal to each other at a sequence generation cycle, and become approximated to each other in a period shorter than the sequence generation cycle.

* * * * *